US012129533B2

(12) United States Patent
Bühler et al.

(10) Patent No.: US 12,129,533 B2
(45) Date of Patent: Oct. 29, 2024

(54) ULTRA-FINE GRAINED STEELS HAVING CORROSION- FATIGUE RESISTANCE

(71) Applicant: TENARIS CONNECTIONS B.V., Amsterdam (NL)

(72) Inventors: Martin Bühler, Villa Mercedes (AR); Matias Gustavo Pereyra, Villa Mercedes (AR)

(73) Assignee: Tenaris Connections B.V., Amsterdam (NL)

( * ) Notice: Subject to any disclaimer, the term of this patent is extended or adjusted under 35 U.S.C. 154(b) by 0 days.

(21) Appl. No.: 16/987,786

(22) Filed: Aug. 7, 2020

(65) Prior Publication Data

US 2020/0370152 A1 Nov. 26, 2020

Related U.S. Application Data

(62) Division of application No. 14/686,071, filed on Apr. 14, 2015, now abandoned.

(51) Int. Cl.
*C21D 6/00* (2006.01)
*C21D 8/06* (2006.01)
(Continued)

(52) U.S. Cl.
CPC ..... *C22C 38/001* (2013.01); *C21D 6/002* (2013.01); *C21D 6/004* (2013.01); *C21D 6/005* (2013.01); *C21D 6/008* (2013.01); *C21D 8/065* (2013.01); *C21D 9/0075* (2013.01); *C22C 38/002* (2013.01); *C22C 38/02* (2013.01);
(Continued)

(58) Field of Classification Search
CPC ..... C21D 6/002; C21D 6/005; C21D 6/008; C21D 8/065; C21D 9/0075; C22C 38/001; C22C 38/002; C22C 38/02; C22C 38/04; C22C 38/06; C22C 38/22; C22C 38/24; C22C 38/26; C22C 38/28; C22C 38/32;
(Continued)

(56) References Cited

U.S. PATENT DOCUMENTS 3,316,395 A 4/1967 Lavin
3,316,396 A 4/1967 Trott et al.
(Continued)

FOREIGN PATENT DOCUMENTS

AR 0050159 A1 10/2006
AT 388791 B 8/1989
(Continued)

OTHER PUBLICATIONS

Peirson, B. (2005) Comparison of the ASTM comparative chart method and the mean line intercept method in determining the effect of solidification rate on the yield strength of AA5182. School of Engineering Grand Valley State University.
(Continued)

*Primary Examiner* — Nicholas A Wang
(74) *Attorney, Agent, or Firm* — Knobbe Martens Olson & Bear, LLP

(57) ABSTRACT

Embodiments of an ultra-fine-grained, medium carbon steel are disclosed herein. In some embodiments, the ultra-fine grained steel can have high corrosion fatigue resistance, as well as high toughness and yield strength. The ultra-fine grained steels can be advantageous for use as sucker rods in oil wells having corrosive environments.

22 Claims, 4 Drawing Sheets

(51) Int. Cl.

| | |
|---|---|
| ***C21D 9/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.

CPC ..... *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/44* (2013.01); *C22C 38/46* (2013.01); *C22C 38/48* (2013.01); *C22C 38/50* (2013.01); *C22C 38/54* (2013.01)

(58) Field of Classification Search

CPC ..... C22C 38/44; C22C 38/46; C22C 38/48; C22C 38/50; C22C 38/54

See application file for complete search history.

(56) References Cited

U.S. PATENT DOCUMENTS

| | | | |
|---|---|---|---|
| 3,325,174 | A | 6/1967 | Weaver |
| 3,362,731 | A | 1/1968 | Gasche et al. |
| 3,366,392 | A | 1/1968 | Kennel |
| 3,413,166 | A | 11/1968 | Zackay et al. |
| 3,489,437 | A | 1/1970 | Duret |
| 3,512,789 | A | 5/1970 | Tanner |
| 3,552,781 | A | 1/1971 | Helland |
| 3,572,777 | A | 3/1971 | Blose et al. |
| 3,575,430 | A | 4/1971 | Alpine |
| 3,592,491 | A | 7/1971 | Glover |
| 3,599,931 | A | 8/1971 | Hanson |
| 3,655,465 | A | 4/1972 | Snape et al. |
| 3,733,093 | A | 5/1973 | Seiler |
| 3,810,793 | A | 5/1974 | Heller |
| 3,854,760 | A | 12/1974 | Duret |
| 3,889,989 | A | 6/1975 | Legris et al. |
| 3,891,224 | A | 6/1975 | Ditcher |
| 3,893,919 | A | 7/1975 | Flegel et al. |
| 3,915,697 | A | 10/1975 | Giuliani et al. |
| 3,918,726 | A | 11/1975 | Kramer |
| 3,986,731 | A | 10/1976 | DeHoff |
| 4,014,568 | A | 3/1977 | Carter et al. |
| 4,147,368 | A | 4/1979 | Baker et al. |
| 4,163,290 | A | 7/1979 | Sutherlin et al. |
| 4,219,204 | A | 8/1980 | Pippert |
| 4,231,555 | A | 11/1980 | Saito |
| 4,299,412 | A | 11/1981 | Parmann |
| 4,305,059 | A | 12/1981 | Benton |
| 4,310,163 | A | 1/1982 | Pippert |
| 4,336,081 | A | 6/1982 | Hijikata et al. |
| 4,345,739 | A | 8/1982 | Wheatley |
| 4,354,882 | A | 10/1982 | Greer |
| 4,366,971 | A | 1/1983 | Lula |
| 4,368,894 | A | 1/1983 | Parmann |
| 4,373,750 | A | 2/1983 | Mantelle et al. |
| 4,376,528 | A | 3/1983 | Ohshimatani et al. |
| 4,379,482 | A | 4/1983 | Suzuki et al. |
| 4,384,737 | A | 5/1983 | Reusser |
| 4,406,561 | A | 9/1983 | Ewing |
| 4,407,681 | A | 10/1983 | Ina et al. |
| 4,426,095 | A | 1/1984 | Buttner |
| 4,445,265 | A | 5/1984 | Olson et al. |
| 4,473,471 | A | 9/1984 | Robichaud et al. |
| 4,475,839 | A | 10/1984 | Strandberg |
| 4,491,725 | A | 1/1985 | Pritchard |
| 4,506,432 | A | 3/1985 | Smith |
| 4,526,628 | A | 7/1985 | Ohno et al. |
| 4,527,815 | A | 7/1985 | Smith |
| 4,564,392 | A | 1/1986 | Ohhashi et al. |
| 4,570,982 | A | 2/1986 | Blose et al. |
| 4,591,195 | A | 5/1986 | Chelette et al. |
| 4,592,558 | A | 6/1986 | Hopkins |
| 4,601,491 | A | 7/1986 | Bell, Jr. et al. |
| 4,602,807 | A | 7/1986 | Bowers |
| 4,623,173 | A | 11/1986 | Handa et al. |
| 4,629,218 | A | 12/1986 | Dubois |
| 4,662,659 | A | 5/1987 | Blose et al. |
| 4,674,756 | A | 6/1987 | Fallon et al. |
| 4,688,832 | A | 8/1987 | Ortloff et al. |
| 4,706,997 | A | 11/1987 | Carstensen |
| 4,710,245 | A | 12/1987 | Roether |
| 4,721,536 | A | 1/1988 | Koch et al. |
| 4,758,025 | A | 7/1988 | Frick |
| 4,762,344 | A | 8/1988 | Perkins et al. |
| 4,812,182 | A | 3/1989 | Fang et al. |
| 4,814,141 | A | 3/1989 | Imai et al. |
| 4,844,517 | A | 7/1989 | Beiley et al. |
| 4,856,828 | A | 8/1989 | Kessler et al. |
| 4,955,645 | A | 9/1990 | Weems |
| 4,958,862 | A | 9/1990 | Cappelli et al. |
| 4,988,127 | A | 1/1991 | Cartensen |
| 5,007,665 | A | 4/1991 | Bovisio et al. |
| 5,067,874 | A | 11/1991 | Foote |
| 5,080,727 | A | 1/1992 | Aihara et al. |
| 5,137,310 | A | 8/1992 | Noel et al. |
| 5,143,381 | A | 9/1992 | Temple |
| 5,154,534 | A | 10/1992 | Guerin et al. |
| 5,180,008 | A | 1/1993 | Aldridge et al. |
| 5,191,911 | A | 3/1993 | Dubois |
| 5,242,199 | A | 9/1993 | Hann et al. |
| 5,328,158 | A | 7/1994 | Lewis et al. |
| 5,348,350 | A | 9/1994 | Blose et al. |
| 5,352,406 | A | 10/1994 | Barteri et al. |
| 5,360,239 | A | 11/1994 | Klementich |
| 5,449,420 | A | 9/1995 | Okada et al. |
| 5,454,883 | A | 10/1995 | Yoshie et al. |
| 5,456,405 | A | 10/1995 | Stagg |
| 5,505,502 | A | 4/1996 | Smith et al. |
| 5,515,707 | A | 5/1996 | Smith |
| 5,538,566 | A | 7/1996 | Gallagher |
| 5,592,988 | A | 1/1997 | Meroni et al. |
| 5,598,735 | A | 2/1997 | Saito et al. |
| 5,653,452 | A | 8/1997 | Järvenkylä |
| 5,712,706 | A | 1/1998 | Castore et al. |
| 5,794,985 | A | 8/1998 | Mallis |
| 5,810,401 | A | 9/1998 | Mosing et al. |
| 5,860,680 | A | 1/1999 | Drijver et al. |
| 5,879,030 | A | 3/1999 | Clayson et al. |
| 5,879,474 | A | 3/1999 | Bhadeshia et al. |
| 5,944,921 | A | 8/1999 | Cumino et al. |
| 5,993,570 | A | 11/1999 | Gray |
| 6,006,789 | A | 12/1999 | Toyooka et al. |
| 6,030,470 | A | 2/2000 | Hensger et al. |
| 6,044,539 | A | 4/2000 | Guzowksi |
| 6,045,165 | A | 4/2000 | Sugino et al. |
| 6,056,324 | A | 5/2000 | Reimert et al. |
| 6,070,912 | A | 6/2000 | Latham |
| 6,173,968 | B1 | 1/2001 | Nelson et al. |
| 6,188,037 | B1 | 2/2001 | Hamada et al. |
| 6,196,530 | B1 | 3/2001 | Muhr et al. |
| 6,217,676 | B1 | 4/2001 | Takabe et al. |
| 6,248,187 | B1 | 6/2001 | Asahi et al. |
| 6,257,056 | B1 | 7/2001 | Shibayama |
| 6,267,828 | B1 | 7/2001 | Kushida et al. |
| 6,311,965 | B1 | 11/2001 | Muhr et al. |
| 6,331,216 | B1 | 12/2001 | Toyooka et al. |
| 6,347,814 | B1 | 2/2002 | Cerruti |
| 6,349,979 | B1 | 2/2002 | Noel et al. |
| 6,358,336 | B1 | 3/2002 | Miyata |

(56) References Cited

U.S. PATENT DOCUMENTS 6,384,388 B1 5/2002 Anderson et al.
6,412,831 B1 7/2002 Noel et al.
6,447,025 B1 9/2002 Smith
6,478,344 B2 11/2002 Pallini, Jr. et al.
6,481,760 B1 11/2002 Noel et al.
6,494,499 B1 12/2002 Galle, Sr. et al.
6,514,359 B2 2/2003 Kawano
6,527,056 B2 3/2003 Newman
6,540,848 B2 4/2003 Miyata et al.
6,550,822 B2 4/2003 Mannella et al.
6,557,906 B1 5/2003 Carcagno
6,558,484 B1 5/2003 Onoe et al.
6,581,940 B2 6/2003 Dittel
6,632,296 B2 10/2003 Yoshinaga et al.
6,648,991 B2 11/2003 Turconi et al.
6,669,285 B1 12/2003 Park et al.
6,669,789 B1 12/2003 Edelman et al.
6,682,610 B1 1/2004 Inoue
6,683,834 B2 1/2004 Ohara et al.
6,709,534 B2 3/2004 Kusinski et al.
6,752,436 B1 6/2004 Verdillon
6,755,447 B2 6/2004 Galle, Jr. et al.
6,764,108 B2 7/2004 Ernst et al.
6,767,417 B2 7/2004 Fujita et al.
6,814,358 B2 11/2004 Keck
6,851,727 B2 2/2005 Carcagno et al.
6,857,668 B2 2/2005 Otten et al.
6,883,804 B2 4/2005 Cobb
6,905,150 B2 6/2005 Carcagno et al.
6,921,110 B2 7/2005 Morotti et al.
6,958,099 B2 10/2005 Nakamura et al.
6,971,681 B2 12/2005 Dell'Erba et al.
6,991,267 B2 1/2006 Ernst et al.
7,014,223 B2 3/2006 Della Pina et al.
7,066,499 B2 6/2006 Della Pina et al.
7,074,283 B2 7/2006 Omura
7,083,686 B2 8/2006 Itou
7,108,063 B2 9/2006 Carstensen
7,118,637 B2 10/2006 Kusinski et al.
7,182,140 B2 2/2007 Wood
7,214,278 B2 5/2007 Kusinski et al.
7,255,374 B2 8/2007 Carcagno et al.
7,264,684 B2 9/2007 Numata et al.
7,284,770 B2 10/2007 Dell'erba et al.
7,310,867 B2 12/2007 Corbett, Jr.
7,431,347 B2 10/2008 Ernst et al.
7,464,449 B2 12/2008 Santi et al.
7,475,476 B2 1/2009 Roussie
7,478,842 B2 1/2009 Reynolds, Jr. et al.
7,506,900 B2 3/2009 Carcagno et al.
7,621,034 B2 11/2009 Roussie
7,635,406 B2 12/2009 Numata et al.
7,735,879 B2 6/2010 Toscano et al.
7,744,708 B2 6/2010 López et al.
7,753,416 B2 7/2010 Mazzaferro et al.
7,862,667 B2 1/2011 Turconi et al.
7,879,287 B2 * 2/2011 Kobayashi ..... C21D 8/0226 420/84
8,002,910 B2 8/2011 Tivelli et al.
8,007,601 B2 8/2011 López et al.
8,007,603 B2 8/2011 Garcia et al.
8,016,362 B2 9/2011 Itoga
8,215,680 B2 7/2012 Santi
8,221,562 B2 7/2012 Valdez et al.
8,262,094 B2 9/2012 Beele
8,262,140 B2 9/2012 Santi et al.
8,317,946 B2 11/2012 Arai et al.
8,322,754 B2 12/2012 Carcagno
8,328,958 B2 12/2012 Turconi et al.
8,328,960 B2 12/2012 Gomez et al.
8,333,409 B2 12/2012 Santi et al.
8,414,715 B2 4/2013 Altschuler et al.
8,544,304 B2 10/2013 Santi
8,636,856 B2 1/2014 Altschuler et al.
8,821,653 B2 9/2014 Anelli et al.
8,840,152 B2 9/2014 Carcagno et al.
8,926,771 B2 1/2015 Agazzi
9,004,544 B2 4/2015 Carcagno et al.
9,163,296 B2 10/2015 Valdez et al.
9,187,811 B2 11/2015 Gomez et al.
9,188,252 B2 11/2015 Altschuler et al.
9,222,156 B2 12/2015 Altschuler et al.
9,234,612 B2 1/2016 Santi et al.
9,340,847 B2 5/2016 Altschuler et al.
9,383,045 B2 7/2016 Santi et al.
9,598,746 B2 3/2017 Anelli et al.
9,644,248 B2 5/2017 Anelli et al.
9,657,365 B2 5/2017 Anelli et al.
9,708,681 B2 7/2017 Eguchi et al.
9,803,256 B2 10/2017 Valdez et al.
9,970,242 B2 5/2018 Narikawa et al.
2001/0035235 A1 11/2001 Kawano
2002/0011284 A1 1/2002 Von Hagen et al.
2002/0153671 A1 10/2002 Raymond et al.
2002/0158469 A1 10/2002 Mannella et al.
2003/0019549 A1 1/2003 Turconi et al.
2003/0111146 A1 6/2003 Kusinski et al.
2003/0116238 A1 6/2003 Fujita
2003/0155052 A1 8/2003 Kondo et al.
2003/0165098 A1 9/2003 Ohara et al.
2003/0168859 A1 9/2003 Watts
2004/0118490 A1 6/2004 Klueh et al.
2004/0118569 A1 6/2004 Brill et al.
2004/0131876 A1 7/2004 Ohgami et al.
2004/0139780 A1 7/2004 Cai et al.
2004/0154706 A1 8/2004 Buck
2004/0187971 A1 * 9/2004 Omura ..... C22C 38/02 148/333
2004/0195835 A1 10/2004 Noel et al.
2004/0262919 A1 12/2004 Dutilleul et al.
2005/0012278 A1 1/2005 Delange
2005/0076975 A1 4/2005 Lopez et al.
2005/0087269 A1 4/2005 Merwin
2005/0093250 A1 5/2005 Santi et al.
2005/0166986 A1 8/2005 Dell'erba et al.
2006/0006600 A1 1/2006 Roussie
2006/0124211 A1 6/2006 Takano et al.
2006/0137781 A1 6/2006 Kusinski et al.
2006/0157539 A1 7/2006 Dubois
2006/0169368 A1 8/2006 Lopez et al.
2006/0231168 A1 10/2006 Nakamura et al.
2006/0243355 A1 11/2006 Haiderer et al.
2006/0273586 A1 12/2006 Reynolds et al.
2007/0039149 A1 2/2007 Roussie
2007/0089813 A1 4/2007 Tivelli
2007/0137736 A1 6/2007 Omura et al.
2007/0216126 A1 9/2007 Lopez et al.
2007/0246219 A1 10/2007 Manella et al.
2008/0047635 A1 2/2008 Konda et al.
2008/0115863 A1 5/2008 McCrink et al.
2008/0129044 A1 6/2008 Carcagno et al.
2008/0219878 A1 9/2008 Konda et al.
2008/0226396 A1 9/2008 Garcia et al.
2008/0226491 A1 9/2008 Satou et al.
2008/0257459 A1 10/2008 Arai et al.
2008/0264129 A1 10/2008 Cheppe et al.
2008/0286504 A1 11/2008 Asahi
2008/0303274 A1 12/2008 Mazzaferro et al.
2008/0314481 A1 12/2008 Garcia et al.
2009/0010794 A1 1/2009 Turconi et al.
2009/0033087 A1 2/2009 Carcagno et al.
2009/0047166 A1 2/2009 Tomomatsu et al.
2009/0101242 A1 4/2009 Lopez et al.
2009/0114318 A1 5/2009 Arai et al.
2009/0148334 A1 6/2009 Stephenson
2009/0226988 A1 9/2009 Satou et al.
2010/0136363 A1 6/2010 Valdez et al.
2010/0187808 A1 7/2010 Santi
2010/0193085 A1 8/2010 Garcia
2010/0206553 A1 8/2010 Bailey et al.
2010/0294401 A1 11/2010 Gomez
2010/0319814 A1 12/2010 Perez
2010/0327550 A1 12/2010 Lopez
2011/0042946 A1 2/2011 Santi

(56) References Cited

U.S. PATENT DOCUMENTS

| | | | | |
|---|---|---|---|---|
| 2011/0077089 | A1 | 3/2011 | Hirai et al. | |
| 2011/0097235 | A1 | 4/2011 | Turconi et al. | |
| 2011/0133449 | A1 | 6/2011 | Mazzaferro | |
| 2011/0233925 | A1 | 9/2011 | Pina | |
| 2011/0247733 | A1 | 10/2011 | Arai et al. | |
| 2011/0259482 | A1* | 10/2011 | Peters | C21D 6/002 148/590 |
| 2011/0284137 | A1 | 11/2011 | Kami et al. | |
| 2012/0018056 | A1 | 1/2012 | Nakagawa et al. | |
| 2012/0199255 | A1* | 8/2012 | Anelli | C22C 38/04 148/593 |
| 2012/0211132 | A1 | 8/2012 | Altschuler | |
| 2012/0267014 | A1 | 10/2012 | Hitoshio et al. | |
| 2013/0000790 | A1 | 1/2013 | Arai et al. | |
| 2013/0004787 | A1 | 1/2013 | Ishiyama et al. | |
| 2013/0264123 | A1 | 10/2013 | Altschuler | |
| 2014/0021244 | A1 | 1/2014 | DuBois | |
| 2014/0027497 | A1 | 1/2014 | Rowland et al. | |
| 2014/0057121 | A1 | 2/2014 | Altschuler | |
| 2014/0137992 | A1 | 5/2014 | Ishiguro et al. | |
| 2014/0251512 | A1 | 9/2014 | Gomez | |
| 2014/0272448 | A1 | 9/2014 | Valdez et al. | |
| 2014/0299235 | A1 | 10/2014 | Anelli | |
| 2014/0299236 | A1 | 10/2014 | Anelli | |
| 2015/0000347 | A1 | 1/2015 | Muntner | |
| 2015/0368986 | A1 | 12/2015 | Narikawa | |
| 2016/0024625 | A1 | 1/2016 | Valdez | |
| 2016/0102856 | A1 | 4/2016 | Minami | |
| 2016/0281188 | A1 | 9/2016 | Valdez et al. | |
| 2016/0305192 | A1 | 10/2016 | Buhler | |

FOREIGN PATENT DOCUMENTS

| | | | |
|---|---|---|---|
| CA | 2319926 | | 7/2008 |
| CN | 1401809 | | 3/2003 |
| CN | 1487112 | | 4/2004 |
| CN | 1292429 | | 12/2006 |
| CN | 101480671 | | 7/2009 |
| CN | 101542002 | | 9/2009 |
| CN | 101613829 | A | 12/2009 |
| CN | 101413089 | | 11/2010 |
| DE | 3310226 | A1 | 10/1984 |
| DE | 4446806 | | 5/1996 |
| EA | 010037 | | 6/2008 |
| EA | 012256 | | 8/2009 |
| EP | 0 032 265 | | 7/1981 |
| EP | 0 092 815 | | 11/1983 |
| EP | 0 104 720 | | 4/1984 |
| EP | 0 151 838 | | 8/1985 |
| EP | 0 159 385 | | 10/1985 |
| EP | 0 309 179 | | 3/1989 |
| EP | 0 340 385 | | 11/1989 |
| EP | 0 329 990 | | 11/1992 |
| EP | 0 658 632 | | 6/1995 |
| EP | 0 753 595 | | 1/1997 |
| EP | 0 788 850 | | 8/1997 |
| EP | 0 828 007 | | 3/1998 |
| EP | 0 989 196 | | 3/2000 |
| EP | 1 008 660 | | 6/2000 |
| EP | 01027944 | | 8/2000 |
| EP | 1 065 423 | | 1/2001 |
| EP | 1 269 059 | | 1/2003 |
| EP | 1 277 848 | | 1/2003 |
| EP | 1 288 316 | | 3/2003 |
| EP | 1 296 088 | | 3/2003 |
| EP | 1 362977 | | 11/2003 |
| EP | 1 413 639 | | 4/2004 |
| EP | 1 182 268 | | 9/2004 |
| EP | 1 705 415 | | 9/2006 |
| EP | 1 717 324 | | 11/2006 |
| EP | 1 726 861 | | 11/2006 |
| EP | 1 876 254 | | 1/2008 |
| EP | 1 914 324 | | 4/2008 |
| EP | 2 000 629 | | 12/2008 |
| EP | 1 554 518 | | 1/2009 |
| EP | 2 028 284 | | 2/2009 |
| EP | 2 133 442 | | 12/2009 |
| EP | 2 216 576 | | 8/2010 |
| EP | 2 239 343 | | 10/2010 |
| EP | 2 778 239 | | 9/2014 |
| EP | 2 479 294 | | 11/2021 |
| FR | 1 149 513 | A | 12/1957 |
| FR | 2 704 042 | A | 10/1994 |
| FR | 2 848 282 | A1 | 6/2004 |
| FR | 2855587 | | 12/2004 |
| GB | 498 472 | | 1/1939 |
| GB | 1 398 214 | | 6/1973 |
| GB | 1 428 433 | | 3/1976 |
| GB | 2 104 919 | A | 3/1983 |
| GB | 2 234 308 | A | 1/1991 |
| GB | 2 276 647 | | 10/1994 |
| GB | 2 388 169 | A | 11/2003 |
| JP | 58-187684 | | 12/1983 |
| JP | 60-086209 | | 5/1985 |
| JP | S60 116796 | A | 6/1985 |
| JP | 60-215719 | | 10/1985 |
| JP | 36025719 | | 10/1985 |
| JP | S61-103061 | | 5/1986 |
| JP | 61 270355 | | 11/1986 |
| JP | 63 004046 | A2 | 1/1988 |
| JP | 63 004047 | A2 | 1/1988 |
| JP | 63 230851 | A2 | 9/1988 |
| JP | 63230847 | A2 | 9/1988 |
| JP | 01-242761 | A | 9/1989 |
| JP | 01 259124 | A2 | 10/1989 |
| JP | 01 259125 | A2 | 10/1989 |
| JP | 01 283322 | A2 | 11/1989 |
| JP | 02-88716 | | 3/1990 |
| JP | 05-098350 | | 12/1990 |
| JP | 403006329 | A | 1/1991 |
| JP | 04 021718 | A2 | 1/1992 |
| JP | 04 107214 | | 4/1992 |
| JP | 04 231414 | A2 | 8/1992 |
| JP | 05 287381 | A2 | 11/1993 |
| JP | H06-042645 | | 2/1994 |
| JP | 06-093339 | | 4/1994 |
| JP | 06 172859 | A2 | 6/1994 |
| JP | 06-220536 | | 8/1994 |
| JP | 07-003330 | | 1/1995 |
| JP | 07 041856 | A2 | 2/1995 |
| JP | 07-139666 | | 5/1995 |
| JP | 07 197125 | A2 | 8/1995 |
| JP | 08 311551 | | 11/1996 |
| JP | H08311551 | * | 11/1996 |
| JP | 09 067624 | A2 | 3/1997 |
| JP | 09-235617 | | 9/1997 |
| JP | 2704042 | | 10/1997 |
| JP | 10 140250 | | 5/1998 |
| JP | 10176239 | | 6/1998 |
| JP | 10 280037 | A | 10/1998 |
| JP | 11 050148 | A | 2/1999 |
| JP | 11140580 | | 5/1999 |
| JP | 11 229079 | | 8/1999 |
| JP | 2000-063940 | | 2/2000 |
| JP | 2000-178645 | | 6/2000 |
| JP | 2000-248337 | A | 9/2000 |
| JP | 2000-313919 | A2 | 11/2000 |
| JP | 2001-131698 | | 5/2001 |
| JP | 2001-164338 | | 6/2001 |
| JP | 2001-172739 | A2 | 6/2001 |
| JP | 2001-220653 | A | 8/2001 |
| JP | 2001-271134 | | 10/2001 |
| JP | 2002-096105 | A2 | 4/2002 |
| JP | 2002-130554 | | 5/2002 |
| JP | 2004-011009 | | 1/2004 |
| JP | 2007-031769 | | 7/2005 |
| JP | 60 174822 | | 9/2005 |
| JP | 2007-31756 | | 2/2007 |
| JP | 2009-293063 | | 12/2009 |
| KR | 0245031 | | 3/2000 |
| KZ | 1418 | B | 12/1994 |
| KZ | 2506 | B | 9/1995 |
| KZ | 2673 | B | 12/1995 |

(56) References Cited

FOREIGN PATENT DOCUMENTS

| | | |
|---|---|---|
| UA | 51138 A | 11/2002 |
| WO | WO 1984/002947 | 8/1984 |
| WO | WO 1994/29627 | 12/1994 |
| WO | WO 1996/22396 | 7/1996 |
| WO | WO 2000/06931 | 2/2000 |
| WO | WO 2000/70107 | 11/2000 |
| WO | WO 2001/075345 | 10/2001 |
| WO | WO 2001/88210 | 11/2001 |
| WO | WO 2002/29290 | 4/2002 |
| WO | WO 2002/035128 | 5/2002 |
| WO | WO 2002/068854 | 9/2002 |
| WO | WO 2002/086369 | 10/2002 |
| WO | WO 2002/093045 | 11/2002 |
| WO | WO 2003/033856 | 4/2003 |
| WO | WO 2003/048623 | 6/2003 |
| WO | WO 2003/087646 | 10/2003 |
| WO | WO 2004/023020 | 3/2004 |
| WO | WO 2004/031420 | 4/2004 |
| WO | WO 2004/033951 | 4/2004 |
| WO | WO 2004/053376 | 6/2004 |
| WO | WO 2004/097059 | 11/2004 |
| WO | WO 2004/109173 | 12/2004 |
| WO | WO 2006/003775 | 6/2005 |
| WO | WO 2006/009142 | 1/2006 |
| WO | WO 2006/087361 | 4/2006 |
| WO | WO 2006/078768 | 7/2006 |
| WO | WO 2007/002576 | 1/2007 |
| WO | WO 2007/017082 | 2/2007 |
| WO | WO 2007/017161 | 2/2007 |
| WO | WO 2007/023806 | 3/2007 |
| WO | WO 2007/028443 | 3/2007 |
| WO | WO 2007/034063 | 3/2007 |
| WO | WO 2007/063079 | 6/2007 |
| WO | WO 2008/003000 | 1/2008 |
| WO | WO 2008/007737 | 1/2008 |
| WO | WO 2008/090411 | 7/2008 |
| WO | WO 2008/110494 | 9/2008 |
| WO | WO 2008/127084 | 10/2008 |
| WO | WO 2009/000851 | 12/2008 |
| WO | WO 2009/000766 | 1/2009 |
| WO | WO 2009/010507 | 1/2009 |
| WO | WO 2009/027308 | 3/2009 |
| WO | WO 2009/027309 | 3/2009 |
| WO | WO 2009/044297 | 4/2009 |
| WO | WO 2009/065432 | 5/2009 |
| WO | WO 2009/106623 | 9/2009 |
| WO | WO 2010/061882 | 6/2010 |
| WO | WO 2010/122431 | 10/2010 |
| WO | WO 2011/152240 | 12/2011 |
| WO | WO 2013/007729 | 1/2013 |
| WO | WO 2013/094179 | 6/2013 |

OTHER PUBLICATIONS

Aggarwal, R. K., et al.: "Qualification of Solutions for Improving Fatigue Life at SCR Touch Down Zone", Deep Offshore Technology Conference, Nov. 8-10, 2005, Vitoria, Espirito Santo, Brazil, in 12 pages.

Anelli, E., D. Colleluori, M. Pontremoli, G. Cumino, A. Izquierdo, H. Quintanilla, "Metallurgical design of advanced heavy wall seamless pipes for deep-water applications", 4th International Conference on Pipeline Technology, May 9 to 13, 2004, Ostend, Belgium.

Asahi, et al., Development of Ultra-high-strength Linepipe, X120, Nippon Steel Technical Report, Jul. 2004, Issue 90, pp. 82-87.

ASM Handbook, Mechanical Tubing and Cold Finishing, Metals Handbook Desk Edition, (2000), 5 pages.

ASTM A 213/A 213M "Standard Specification for Seamless Ferritic and Austenitic Alloy-Steel Boiler, Superheater, and Heat-Exchanger Tubes".

ASTM A182/A182M "Standard Specification for Forged or Rolled Alloy and Stainless Steel Pipe Flanges, Forged Fittings, and Valves and Parts for High-Temperature Service".

ASTM A336/A336M "Standard Specification for Alloy Steel Forgings for Pressure and High-Temperature Parts".

ASTM A355 which is related to "Seamless Ferritic Alloy-Steel Pipe for High-Temperature Service".

ASTM, "E112-13 Standard Test Methods for Determining Average Grain Size," ASTM International. 2012. p. 1-28.

Bai, M., D. Liu, Y. Lou, X. Mao, L. Li, X. Huo, "Effects of Ti addition on low carbon hot strips produced by CSP process", Journal of University of Science and Technology Beijing, 2006, vol. 13, N° 3, p. 230.

Beretta, Stefano et al., "Fatigue Assessment of Tubular Automotive Components in Presence of Inhomogeneities", Proceedings of IMECE2004, ASME International Mechanical Engineering Congress, Nov. 13-19, 2004, pp. 1-8.

Berner, Robert A., "Tetragonal Iron Sulfide", Science, Aug. 31, 1962, vol. 137, Issue 3531, p. 669.

Berstein et al., "The Role of Traps in the Microstructural Control of Hydrogen Embrittlement of Steels" Hydrogen Degradation of Ferrous Alloys, Ed. T. Oriani, J. Hirth, and M. Smialowski, Noyes Publications, 1988, pp. 641-685.

Boulegue, Jacques, "Equilibria in a sulfide rich water from Enghien-les-Bains, France", Geochimica et Cosmochimica Acta, Pergamon Press, 1977, vol. 41, pp. 1751-1758, Great Britain.

Bruzzoni et al., "Study of Hydrogen Permeation Through Passive Films on Iron Using Electrochemical Impedance Spectroscopy", PhD Thesis, 2003, Universidad Nacional del Comahue de Buenos Aires, Argentina.

Cancio et al., "Characterization of microalloy precipitates in the austenitic range of high strength low alloy steels", Steel Research, 2002, vol. 73, pp. 340-346.

Carboni, A., A. Pigani, G. Megahed, S. Paul, "Casting and rolling of API X 70 grades for artic application in a thin slab rolling plant", Stahl u Eisen, 2008, N° 1, p. 131-134.

Chang, L.C., "Microstructures and reaction kinetics of bainite transformation in Si-rich steels," XP0024874, Materials Science and Engineering, vol. 368, No. 1-2, Mar. 15, 2004, pp. 175-182, Abstract, Table 1.

Chitwood, G. B., et al.: "High- Strength Coiled Tubing Expands Service Capabilities", as presented at the 24th Annual OTC in Houston, Texas, May 4-7, 1992, in 15 pages.

Clark, A. Horrell, "Some Comments on the Composition and Stability Relations of Mackinawite", Neues Jahrbuch fur Mineralogie, 1966, vol. 5, pp. 300-304, London, England.

Craig, Bruce D., "Effect of Copper on the Protectiveness of Iron Sulfide Films", Corrosion, National Association of Corrosion Engineers, 1984, vol. 40, Issue 9, pp. 471-474.

D.O.T. 178.68 Spec. 39, pp. 831-840, Non reusable (non refillable) cylinders, Oct. 1, 2002.

Davis, J.R., et al. "ASM—Speciality Handbook—Carbon and alloy steels" ASM Speciality Handbook, Carbon and Alloy Steels, 1996, pp. 12-27, XP002364757 US.

De Medicis, Rinaldo, "Cubic FeS, A Metastable Iron Sulfide", Science, American Association for the Advancement of Science, Steenbock Memorial Library, Dec. 11, 1970, vol. 170, Issue 3963, pp. 723-728.

Drill Rod Joint Depth Capacity Chart, downloaded Jan. 15, 2013; http://www.boartlongyear.com/drill-rod-joint-depth-capacity-chart.

E. Anelli, et al., "Metallurgical Design of Advanced Heavy Wall Seamless pipes for Deepwater Applications", 4th International Conference on Pipeline Technology, May 9-13, 2004, Ostend, Belgium.

Echaniz, "The effect of microstructure on the KISSC of low alloy carbon steels", Nace Corrosion '98, EE. UU., Mar. 1998, pp. 22-27, San Diego.

Echaniz, G., Morales, C., Perez, T., "Advances in Corrosion Control and Materials in Oil and Gas Production" Papers from Eurocorr 97 and Eurocorr 98, 13, P. S. Jackman and L.M. Smith, Published for the European Federation of Corrosion, No. 26, European Federation of Corrosion Publications, 1999.

Extrait du Catalogue N 940, 1994.

Fang, Hong-Sheng, et al.: "The Developing Prospect of Air-cooled Bainitic Steels", International Journal of Issi, vol. 2, No. 2, Feb. 1, 2005, pp. 9-18.

(56) References Cited

OTHER PUBLICATIONS

Fratini et al.: "Improving friction stir welding of blanks of different thicknesses," Materials Science and Engineering A 459 (2007).
Fritz T et al, "Characterization of electroplated nickel", Microsystem Technologies, Dec. 31, 2002, vol. 9, No. 1-2, pp. 87-91, Berlin, DE.
Gojic, Mirko and Kosec, Ladislav, , "The Susceptibility to the Hydrogen Embrittlement of Low Alloy Cr and CrMo Steels", ISIJ International, 1997, vol. 37, Issue 4, pp. 412-418.
Gomez, G., et al.: "Air cooled bainitic steels for strong, seamless pipes—Part 1—allowy design, kinetics and microstructure", Materials Science and Technology, vol. 25, No. 12, Dec. 1, 2009. (XP002611498).
Heckmann, et al., Development of low carbon Nb—Ti—B microalloyed steels for high strength large diameter linepipe, Ironmaking and Steelmaking, 2005, vol. 32, Issue 4, pp. 337-341.
Hollomon, J.H., et al., Time-tempered Relations in Tempering Steel. New York Meeting, pp. 223-249, 1945.
Howells, et al.: "Challenges for Ultra-Deep Water Riser Systems", IIR, London, Apr. 1997, 11 pages.
Hutchings et al., "Ratio of Specimen thickness to charging area for reliable hydrogen permeation measurement", British Corrosion. Journal, 1993, vol. 28, Issue 4, pp. 309-312.
Iino et al., "Aciers pour pipe-lines resistant au cloquage et au criquage dus a l'hydrogene", Revue de Metallurgie, 1979, vol. 76, Issue 8-9, pp. 591-609.
Ikeda et al., "Influence of Environmental Conditions and Metallurgical Factors on Hydrogen Induced Cracking of Line Pipe Steel", Corrosion/80, National Association of Corrosion Engineers, 1980, vol. 8, pp. 8/1-8/18, Houston, Texas.
ISO. Petroleum and natural gas industries—Materials for use in H2Scontaining environments in oil and gas production. ANSI/NACE ISO, 145 pages, 2009.
Izquierdo, et al.: "Qualification of Weldable X65 Grade Riser Sections with Upset Ends to Improve Fatigue Performance of Deepwater Steel Catenary Risers", Proceedings of the Eighteenth International Offshore and Polar Engineering Conference, Vancouver, BC, Canada, Jul. 6-11, 2008, p. 71.
Jacobs, Lucinda and Emerson, Steven, "Trace Metal Solubility in an Anoxid Fjord", Earth and Planetary Sci. Letters, Elsevier Scientific Publishing Company, 1982, vol. 60, pp. 237-252, Amsterdam, Netherlands.
Johnston, P. W., G.Brooks, "Effect of Al2O3 and TiO2 Additions on the Lubrication Characteristics of Mould Fluxes", Molten Slags, Fluxes and Salts '97 Conference, 1997 pp. 845-850.
Kazutoshi Ohashi et al., "Evaluation of r-value of steels using Vickers hardness test", Journal of Physics: Conference Series, Aug. 7, 2012, p. 12045, vol. 379, No. 1, Institute of Physics Publishing, Bristol, GB.
Keizer, Joel, "Statistical Thermodynamics of Nonequilibrium Processes", Springer-Verlag, 1987.
Kishi, T., H.Takeucgi, M.Yamamiya, H.Tsuboi, T.Nakano, T.Ando, "Mold Powder Technology for Continuous Casting of Ti-Stabilized Stainless Steels", Nippon Steel Technical Report, No. 34, Jul. 1987, pp. 11-19.
Korolev, D. F., "The Role of Iron Sulfides in the Accumulation of Molybdenum in Sedimentary Rocks of the Reduced Zone", Geochemistry, 1958, vol. 4, pp. 452-463.
Lee, Sung Man and Lee, Jai Young, "The Effect of the Interface Character of TiC Particles on Hydrogen Trapping in Steel", Acta Metall., 1987, vol. 35, Issue 11, pp. 2695-2700.
Tivelli et al., "Metakkurgical Aspects of Heavy Wall—High Strength Seamless Pipes for Deep Water Applications", RioPipeline, Oct. 17-19, 2005, Rio, Brasil.
Mechanical Tubing and Cold Finishing, Metals Handbook Desk Edition, (2000), 5 pages.
Mehling, Wilfred L.: "Hot Upset Forging," ASM Handbook vol. 14, 1998, pp. 84-95.
Mishael, et al., "Practical Applications of Hydrogen Permeation Monitoring," Corrosion, Mar. 28-Apr. 1, 2004, Corrosion 2004, Nacional Association of Corrosion Engineers, vol. Reprint No. 04476.
Morice et al., "Möessbauer Studies of Iron Sulfides", J. Inorg. Nucl. Chem., 1969, vol. 31, pp. 3797-3802.
Mukongo, T., P.C.Pistorius, and A.M.Garbers-Craig, "Viscosity Effect of Titanium Pickup by Mould Fluxes for Stainless Steel", Ironmaking and Steelmaking, 2004, vol. 31, No. 2, pp. 135-143.
Mullet et al., "Surface Chemistry and Structural Properties of Mackinawite Prepared by Reaction of Sulfide lons with Metallic Iron", Geochimica et Cosmochimica Acta, 2002, vol. 66, Issue 5, pp. 829-836.
Murcowchick, James B. and Barnes, H.L., "Formation of a cubic FeS", American Mineralogist, 1986, vol. 71, pp. 1243-1246.
NACE MR0175/ISO 15156-1 Petroleum and natural gas industries-Materials for use in H2S-containing Environments in oil and gas production—Part 1: General principles for selection of cracking-resistant materials, Jun. 28, 2007.
Nagata, M., J. Speer, D. Matlock, "Titanium nitride precipitation behavior in thin slab cast high strength low alloyed steels", Metallurgical and Materials Transactions A, 2002 , vol. 33A, p. 3099-3110.
Nakai et al., "Development of Steels Resistant to Hydrogen Induced Cracking in Wet Hydrogen Sulfide Environment", Transactions of the ISIJ, 1979, vol. 19, pp. 401-410.
Nandan et al.: "Recent advances in friction-stir welding—Process, weldment structure and properties," Progress in Materials Science 53 (2008) 980-1023.
Pollack, Herman, W., Materials Science and Metallurgy, Fourth Edition, pp. 96 and 97, 1988.
Pressure Equipment Directive 97/23/EC, May 29, 1997, downloaded from website:http://ec.europa.eu/enterprise/pressure_equipment/ped/index_en.html on Aug. 4, 2010.
Prevéy, Paul, et al., "Introduction of Residual Stresses To Enhance Fatigue Performance in the Initial Design", Proceedings of Turbo Expo 2004, Jun. 14-17, 2004, pp. 1-9.
Rickard, D.T., "The Chemistry of Iron Sulphide Formation at Low Temperatures", Stockholm Contrib. Geol., 1969, vol. 26, pp. 67-95.
Riecke, Ernst and Bohnenkamp, Konrad, "Uber den Einfluss von Gittersoerstellen in Eisen auf die Wassersroffdiffusion", Z. Metallkde . . ., 1984, vol. 75, pp. 76-81.
Savatori et al.: European Commssion Report, EUR 2006, EUR2207, 3 pp. STN_ABSTRACT.
Seamless Steel Tubes for Pressure Purposes—Technical Delivery Conditions-Part 1: Non-alloy Steel Tubes with Specified Room Temperature Properties British Standard BS EN 10216-1:2002 E:1-26, published May 2002.
Seamless Steel Tubes for Pressure Purposes—Technical Delivery Conditions-Part 2: Non-alloy and Alloy Steel Tubes with Specified Elevated Temperature Properties British Standard BS EN 10216-2:2002+A2:2007:E:1-45, published Aug. 2007.
Seamless Steel Tubes for Pressure Purposes-Technical Delivery Conditions—Part 3: Alloy Fine Grain Steel Tubes British Standard BS EN 10216-3:2002 +A1:2004 E:1-34, published Mar. 2004.
Seamless Steel Tubes for Pressure Purposes—Technical Delivery Conditions-Part 4: Non-alloy and Alloy Steel Tubes with Specified Low Temperature Properties British Standard BS EN 10216-4:2002 +A1:2004 E:1-30, published Mar. 2004.
Shanabarger, M.R. and Moorhead, R. Dale, "H2O Adsorption onto clean oxygen covered iron films", Surface Science, 1996, vol. 365, pp. 614-624.
Shoesmith, et al., "Formation of Ferrous Monosulfide Polymorphs During Corrosion of Iron by Aqueous Hydrogen Sulfide at 21 degrees C", Journal of the Electrochemical Society, 1980, vol. 127, Issue 5, pp. 1007-1015.
Skoczylas, G., A.Dasgupta, R.Bommaraju, "Characterization of the chemical interactions during casting of High-titanium low carbon enameling steels", 1991 Steelmaking Conference Proceeding, pp. 707-717.
Smyth, D., et al.: Steel Tubular Products, Properties and Selection: Irons, Steels, and High-Performance Alloys, vol. 1, ASM Handbook, ASM International, 1990, p. 327-336.

(56) References Cited

OTHER PUBLICATIONS

Specification for Threading, Gauging and Thread Inspection of Casing, Tubing, and Line Pipe Threads, American Petroleum Institute, Specification 5B, Apr. 2008, 15th Edition (Excerpts Only).
Spry, Alan, "Metamorphic Textures", Perganon Press, 1969, New York.
Taira et al., "HIC and SSC Resistance of Line Pipes for Sour Gas Service", Nippon Kokan Technical Report, 1981, vol. 31, Issue 1-13.
Taira et al., "Study on the Evaluation of Environmental Condition of Wet Sour Gas", Corrosion 83 (Reprint. No. 156, National Association of Corrosion Engineers), 1983, pp. 156/2-156/13, Houston, Texas.
Takeno et al., "Metastable Cubic Iron Sulfide—With Special Reference to Mackinawite", American Mineralogist, 1970, vol. 55, pp. 1639-1649.
Tenaris brochure. Coiled Tubes HS80CRA, 2 pages, 2008.
Tenaris brochure. Coiled Tubes Suggested Field Welding Procedure (GTAW) for Coiled Tubing Grads HS70, HS80, HS90, HS11 0, 3 pages, 2007.
Tenaris brochure. Coiled Tubing for Downhole Applications, 10 pages, 2007.
Tenaris Newsletter for Pipeline Services, Apr. 2005, p. 1-8.
Tenaris Newsletter for Pipeline Services, May 2003, p. 1-8.
Thethi, et al.: "Alternative Construction for High Pressure High Temperature Steel Catenary Risers", OPT USA, Sep. 2003, p. 1-13.
Thewlis, G., Weldability of X100 linepipe, Science and Technology of Welding and Joining, 2000, vol. 5, Issue 6, pp. 365-377.
Tivelli, M., G. Cumino, A. Izquierdo, E. Anelli, A. Di Schino, "Metallurgical Aspects of Heavy Wall-High Strength Seamless Pipes for Deep Water Applications", RioPipeline 2005, Oct. 17 to 19, 2005, Rio (Brasil), Paper n° IBP 1008_05.
Todoroki, T. Ishii, K. Mizuno, A. Hongo, "Effect of crystallization behavior of mold flux on slab surface quality of a Ti-bearing Fe—Cr—Ni super alloy cast by means of continuous casting process", Materials Science and Engineering A, 2005, vol. 413-414, p. 121-128.
Turconi, G. L.: "Improvement of resistance to SSC initiation and propagation of high strength OCTG through microstructure and precipitation control"; "Paper 01077", NACE International, Houston, TX, Mar. 16, 2001. (XP009141583).
Vaughan, D. J. and Ridout, M.S., "Moessbauer Studies of Some Sulphide Minerals", J. Inorg Nucl. Chem., 1971, vol. 33, pp. 741-746.
Wegst, C.W., "Stahlüssel", Auflage 1989, Seite 119, 2 pages.
Canale et al., A historical overview of steel tempering parameters, International Journal of Microstructure and Materials Properties, vo. 3, Nos. 4-5, 2008, pp. 474-525.
One-stop-shop for induction tube technologies, SMS Elotherm GmbH, Jul. 2014, p. 48.

* cited by examiner

ULTRA-FINE GRAINED STEELS HAVING CORROSION- FATIGUE RESISTANCE

BACKGROUND

Field

Embodiments of the present disclosure relate to ultra-fine grained steels which can have excellent toughness and high fatigue resistance in corrosive environments.

Description of the Related Art

A sucker rod is a steel solid bar, typically between 25 and 30 feet in length, upset and threaded at both ends, used in the oil and gas industry to connect components at the surface and the bottom of a well. Sucker rods can be used in, for example, reciprocating rod lifts and progressive cavity pumping systems. Due to the alternating movement of the system, fatigue is a common failure mechanism of sucker rods in service.

Typically, there can be a strong correlation between fatigue strength and tensile strength for steels up to about 170 ksi. However, under the effect of a harsh environment, which very frequently occurs in oil wells, the correlation may no longer be valid because the presence of hydrogen sulfide ($H_2S$), carbon dioxide ($CO_2$), chlorides, and other compounds in aqueous solutions, can considerably reduce the fatigue life of the components.

Accordingly, corrosion is a major issue in the oil and gas industry, requiring special considerations in the selection of materials and well design. There are many factors influencing the initiation of one or several corrosion processes. These factors include pH, pressure, potential, temperature, fluid flow, concentration (solution constituents), and water cut. Further, increased volumes of injection water/gas for mature fields and shale operations can increase the risk of failures related to corrosion processes.

SUMMARY

Disclosed herein are embodiments of a steel sucker rod formed from a steel composition comprising iron and, by weight:

0.15-0.4% carbon;
0.1-1.0% manganese;
0.5-1.5% chromium;
0.01-0.1% aluminum;
0.2-0.35% silicon;
0.1-1.0% molybdenum;
0.01-0.05% niobium;
0.005-0.03% titanium; and
0.0001-0.005% boron;

wherein the steel has a final microstructure comprising tempered martensite, and wherein an average grain size of the final microstructure is between about 2 and about 5 micrometers.

In some embodiments, the rod can have approximately twice the average life of conventional sucker rod materials in corrosion fatigue under $CO_2$ or $H_2S$ environments. In some embodiments, the chemical composition can further comprise 0 to 0.05 wt. % vanadium, and 0 to 0.2 wt. % nickel. In some embodiments, the final microstructure can comprise at least 90 volume % tempered martensite. In some embodiments, the steel sucker rod can comprise a yield strength greater than about 100 ksi, an ultimate tensile strength between about 115 and about 140 ksi, and a minimum absorbed energy in Charpy V-notch impact test of 100 Joules at room temperature. In some embodiments, the steel composition can further comprise by weight, less than 0.01% sulfur, less than 0.015% nitrogen, and less than 0.02% phosphorus.

In some embodiments, the steel composition can comprise, by weight:

0.15-0.3% carbon;
0.3-0.7% manganese;
0.2-0.35% silicon;
0.01-0.05% niobium;
less than 0.008% sulfur;
less than 0.018% phosphorus;
less than 0.015% nitrogen;
0.5-1.2% chromium;
0.2-0.8% molybdenum;
0.01-0.03% titanium;
0.0010 to 0.0025% boron; and
0.01 to 0.05% aluminum.

In some embodiments, the steel composition can comprise, by weight:

0.2-0.3% carbon;
0.4-0.7% manganese;
0.2-0.3% silicon;
0.02-0.04% niobium;
less than 0.005% sulfur;
less than 0.015% phosphorus;
less than 0.01 nitrogen;
0.8-1.2% chromium;
0.3-0.8% molybdenum;
0.01-0.02% titanium;
0.001 to 0.002% boron; and
0.01 to 0.04% aluminum.

In some embodiments, the steel composition can satisfy the formula: (Al/27+Ti/48+V/51+Nb/93−N/14)*100 between about 0.08 and about 0.15% by weight. In some embodiments, the steel composition can satisfy the formulas: C+Mn/10 between about 0.1 and about 0.4% by weight, and Ni/10+Cr/12+Mo/8+Nb/2+20*B+V between about 0.1 and about 0.25% by weight. In some embodiments, the steel composition can satisfy the formulas: C+Mn/10 between about 0.2 and about 0.3% by weight, and Ni/10+Cr/12+Mo/8+Nb/2+20*B+V between about 0.15 and about 0.25% by weight.

Also disclosed herein are embodiments of a method of manufacturing a steel sucker rod, the method comprising providing a steel composition comprising iron and:

0.15-0.4 wt. % carbon;
0.1-1.0 wt. % manganese;
0.5-1.5 wt. % chromium;
0.2-0.35 wt. % silicon;
0.1-1.0 wt. % molybdenum;
0.01-0.05 wt. % niobium;
0.005-0.03 wt. % titanium;
0.0001 to 0.0025 wt. % boron;
0.01 to 0.1 wt. % aluminum;

hot rolling the steel composition at a forging ratio greater than about 15, austenitizing the hot rolled steel composition at a temperature between the critical temperature (Ac3) and a maximum temperature that satisfies the formula T max=1025° C.-210° C.*sqrt(wt % C)+50° C.*wt % Mo; quenching the steel composition below about 100° C. at a rate to produce a martensitic microstructure, and tempering at a temperature between 565° C. and a lower critical temperature (Ac1) to form tempered martensite, wherein a time between a maximum austenitizing and quenching is between 1 second and 10 seconds, and wherein an austenitic grain size prior to quenching is 5 microns or less.

In some embodiments, the austenitizing and tempering treatments are characterized by temperature equivalent parameters $$P_{A/T}(T, t) = -B \Big/ \ln\left[\int_0^t \exp\left(-\frac{Q}{R \cdot T}\right) \cdot dt\right],$$

where T is the absolute temperature in ° K, t is the time in seconds, R is the gas constant (J/mol ° K), Q is an activation energy (425,000 J/mol) and B is a constant (14,000° C.), $P_A$ is below 800° C., $P_T$ is above 700° C., and the difference between $P_A$ and $P_T$ is less than or equal to 200° C.

In some embodiments, the steel composition can comprise 0 to 0.05 wt. % vanadium, and 0 to 0.2 wt. % nickel. In some embodiments, the difference between $P_A$ and $P_T$ can be less than 100° C. In some embodiments, the austenitic grain size prior to quenching can be between 2 and 5 microns. In some embodiments, the steel can be quenched at a rate greater than about 50° C./sec.

In some embodiments, the steel composition can comprise, by weight:

0.15-0.3% carbon;
0.3-0.7% manganese;
0.2-0.35% silicon;
0.01-0.05% niobium;
less than 0.008% sulfur;
less than 0.018% phosphorus;
less than 0.015% nitrogen;
0.5-1.2% chromium;
0.2-0.8% molybdenum;
0.01-0.03% titanium;
0.0010 to 0.0025% boron; and
0.01 to 0.05% aluminum.

In some embodiments, the steel composition can comprise, by weight:

0.2-0.3% carbon;
0.4-0.7% manganese;
0.2-0.3% silicon;
0.02-0.04% niobium;
less than 0.005% sulfur;
less than 0.015% phosphorus;
less than 0.01 nitrogen;
0.8-1.2% chromium;
0.3-0.8% molybdenum;
0.01-0.02% titanium;
0.001 to 0.002% boron; and
0.01 to 0.04% aluminum.

Also disclosed herein are embodiments of a steel formed from a steel composition comprising iron and, by weight:

0.15-0.4% carbon;
0.1-1.0% manganese;
0.5-1.5% chromium;
0.01-0.1% aluminum;
0.2-0.35% silicon;
0.1-1.0% molybdenum;
0.01-0.05% niobium;
0.005-0.03% titanium; and
0.0001-0.0025% boron;

wherein the steel has a final microstructure comprising tempered martensite, and wherein an average grain size of the final microstructure is between about 2 and about 5 micrometers.

DETAILED DESCRIPTION

Figure 1:
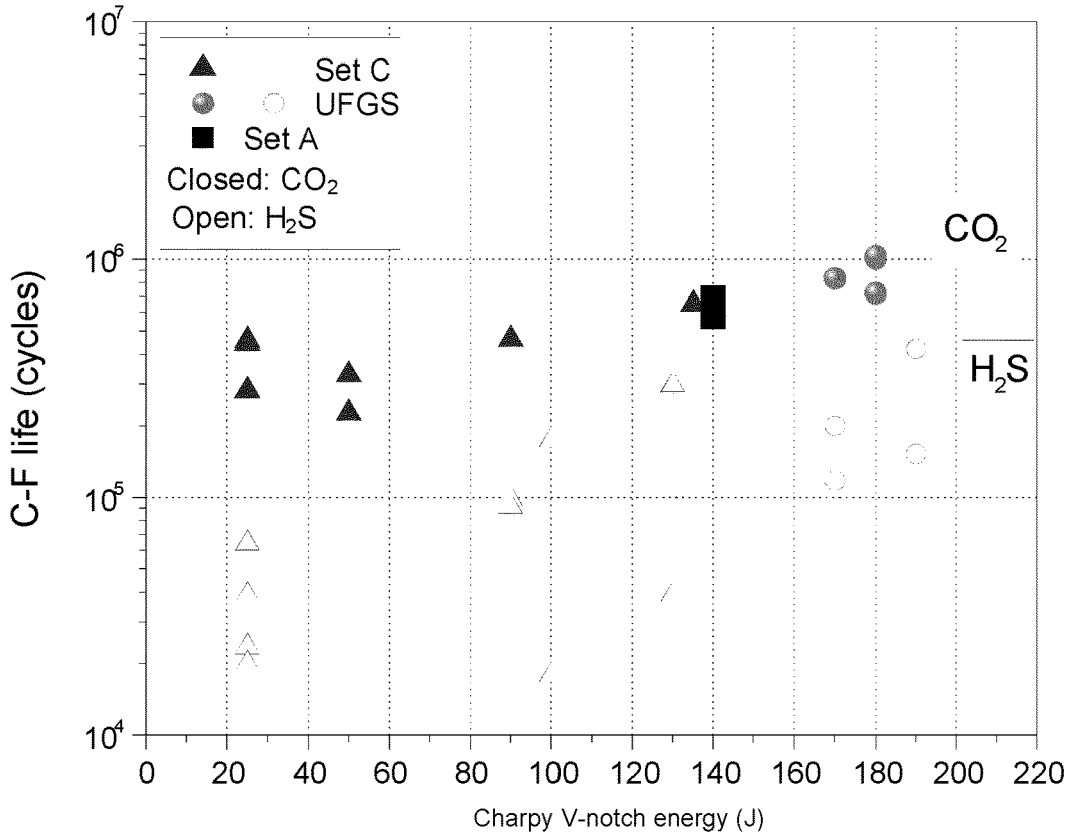
FIG. 1 illustrates testing results showing a correlation between corrosion-fatigue life in harsh environments and impact toughness for embodiments of an ultra-fined-grained steel as compared to steels of the prior art.

Embodiments of the present disclosure are directed to ultra-fine-grained steels (UFGSs), and methods of manufacturing such steels. In general, the term ultra-fine-grain is used for average grain sizes of 5 μm and below (or about 5 μm and below), below 5 μm (or below about 5 μm), preferably between 1 μm and 2 μm (or between about 1 μm and about 2 μm) in diameter. Embodiments of the disclosed steels can have advantageous properties for use in an oil well. For example, embodiments of the disclosed steel can be used to form sucker rods having excellent toughness and a high fatigue resistance in corrosive environments (e.g., carbon dioxide and/or seawater). These improved properties can be achieved by, in some embodiments, combining a specific steel composition with a specific microstructure. Further, in some embodiments good process control, such as for hot rolling and heat treatment, can be further used to adjust the properties of a steel.

Specifically, embodiments of the present disclosure can have an ultra-fine grain martensitic microstructure, achieved through a fast induction heating to austenitizing temperature followed by a fast water quenching, combined with a selected chemical composition with a proper combination of C, Mn, Cr, Mo and other microalloying elements. Additionally, a fine carbide dispersion and a low dislocation density can be achieved with a high tempering temperature, while still maintaining high strength. In some embodiments, the microstructure right before quenching, after quenching, and after tempering can be identical or substantially identical.

From the point of view of the materials, some parameters for achieving advantageous corrosion-fatigue resistance can include the steel chemistry, such as alloy additions and steel cleanliness, microstructure, mechanical properties and toughness. While the effect of steel chemical composition, structure and properties in corrosion and stress cracking has been extensively investigated, the mechanism of corrosion fatigue has not well been understood.

However, it has been experimentally found that toughness can have a direct relationship with corrosion-fatigue resistance in different harsh environments. In some embodiments, an advantageous material can be moderately corrosion resistant, with good sulfide stress cracking performance, good fatigue strength and excellent toughness. These conditions can be achieved with an ultra-fine grain martensitic microstructure, combined with the proper chemical composition (in terms of microalloying elements and steel cleanliness), fine carbide dispersion and a low dislocations density (achieved with a high tempering temperature), such as those described herein. Particularly, it has been observed that reducing the austenite grain size can notably increase toughness at a given strength level. Moreover, control of carbides precipitation, in terms of distribution and size, can also be advantageous in achieving corrosion-fatigue resistance.

In view of the many factors mentioned above, several tests and analyses were performed for different materials. Various chemical compositions and different heat treatments were also investigated. The behavior of the materials was analyzed using several techniques and tests, in aggressive environments, looking for stronger steels. Particularly, the corrosion fatigue resistance was measured using time-to-failure tests: cycling tensile loads were applied in different harsh environments like those encountered in the oil and gas industry, at selected pressure and temperature. Specifically, corrosion fatigue is the conjoint action of a cyclic stress and a corrosive environment to decrease the number of cycles to failure in comparison to the life when no corrosion is present.

An advantageous combination of chemical composition and heat treatment was achieved that can improve the performance of certain steels under corrosion fatigue conditions. Furthermore, it was found that there is a good correlation between corrosion fatigue performance and material toughness that allows better understanding of the behavior.

Figure 3:
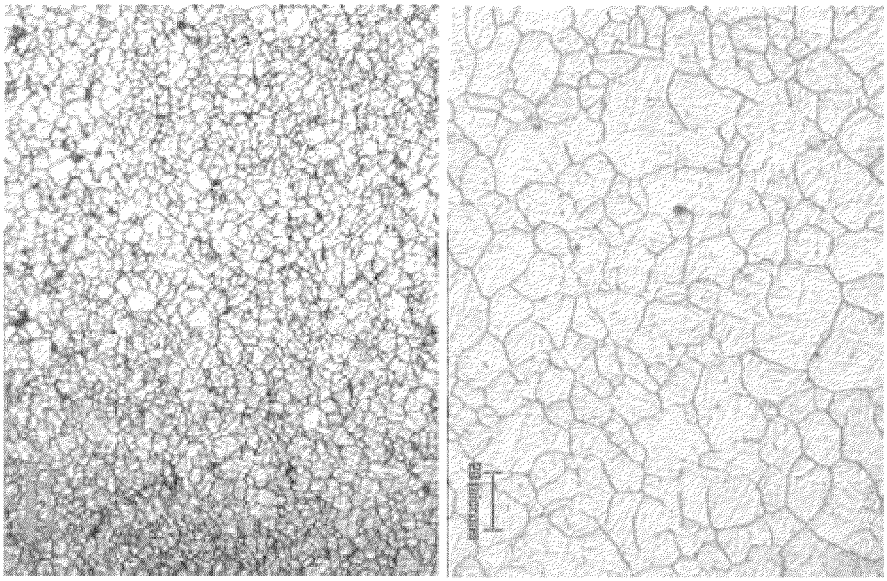
FIG. 3 illustrates the effect of heat treatment on grain size for some embodiments of a steel composition. Both steels shown have the same composition and the same magnification but (left) underwent fast heating and (right) underwent conventional heating.

Moreover, the selection of a proper chemical composition (in terms of microalloying elements and steel cleanliness) combined with certain heat treatments, can lead to a better microstructure to reach improved toughness. Particularly, it has been observed that reducing the austenite grain size can noticeably increase toughness at a given strength level. FIG. 3 depicts the effect of heat treatment on grain size of steels formed having a composition in the last row of Table 1 below. The steel shown in the left figure was heated to an austenitizing temperature at a rate of 100° C./s, while the heat rate for the right figure is below 1° C./s. The photographs shown in FIG. 3 were taken in the as-quenched condition for better accuracy, and it should be noted that tempering does not modify the prior austenitic grain size.

As shown, a fast heating leads to a very much thinner grain, and thus smaller subunits of the grain such as, for example, packets and lathes, compared with conventional heating, in the same steel composition. As explained, this reduction in grain size notably increases the toughness of the material.

Steel, such as in the form of a sucker rod, can be fabricated from a low alloy steel (medium C, Mn—Cr—Mo—Nb—Ti), hot rolled bar, with a tight chemical composition, heat treated by induction heating, water quenching and tempering. A high forging ratio, determined as the area ratio before and after hot rolling, and the tight control of the austenitizing process, can provide an ultra-fine grained martensitic microstructure.

Composition

The steel composition of certain embodiments of the present disclosure can be a steel alloy comprising carbon (C) and other alloying elements such as manganese (Mn), silicon (Si), chromium (Cr), boron (B), molybdenum (Mo), niobium (Nb), aluminum (Al) and titanium (Ti). Additionally, one or more of the following elements may be optionally present and/or added as well: vanadium (V) and Nickel (Ni). The remainder of the composition can comprise iron (Fe) and impurities. In certain embodiments, the concentration of impurities may be reduced to as low as an amount as possible. Embodiments of impurities may include, but are not limited to, sulfur (S), phosphorous (P) and nitrogen (N). Residuals of lead (Pb), tin (Sn) antimony (Sb), arsenic (As), and bismuth (Bi) may be found in a combined maximum of 0.05% by weight (or about 0.05% by weight).

In some embodiments, a steel rod can comprise a composition of, by weight 0.15-0.4% (or about 0.15-0.4%) carbon (C), 0.1-1.0% (or about 0.1-1.0%) manganese (Mn), 0.5-1.5% (or about 0.5-1.5%) chromium (Cr), 0.2-0.35% (or about 0.2-0.35%) silicon (Si), 0.1-1.0% (or about 0.1-1.0%) molybdenum (Mo), 0.01-0.05% (or about 0.01-0.05%) niobium (Nb), 0.005-0.03% (or about 0.005-0.03%) titanium (Ti), 0.0001 to 0.0050% (or about 0.0001-0.0050%) boron (B) and 0.01 to 0.1% (or about 0.01-0.1%) aluminum (Al). Additionally, one or more of the following elements may be optionally present and/or added as well: 0 to 0.05% (or about 0-0.05%) vanadium (V) and 0 to 0.2% (or about 0-0.2%) nickel (Ni), and the remainder being iron and unavoidable impurities. In some embodiments, the steel rod can further comprise less than 0.01% (or less than about 0.01%) sulfur, less than 0.02% (or less than about 0.02%) phosphorus and less than 0.02% (or less than about 0.02%) nitrogen.

In some embodiments, a steel rod can comprise a composition of, by weight 0.15-0.3% (or about 0.15-0.3%) carbon (C), 0.3-0.7% (or about 0.3-0.7%) manganese (Mn), 0.5-1.2% (or about 0.5-1.2%) chromium (Cr), 0.2-0.35% (or about 0.2-0.35%) silicon (Si), 0.2-0.8% (or about 0.2-0.8%) molybdenum (Mo), 0.01-0.05% (or about 0.01-0.05%) niobium (Nb), 0.01-0.03% (or about 0.01-0.03%) titanium (Ti), 0.0010 to 0.0025% (or about 0.0010-0.0025%) boron (B), 0.01 to 0.05% (or about 0.01-0.05%) aluminum (Al), and the remainder being iron and unavoidable impurities. In some embodiments, the steel rod can further comprise less than 0.008% (or less than about 0.008%) sulfur, less than 0.018% (or less than about 0.018%) phosphorus and less than 0.015% (or less than about 0.015%) nitrogen.

Cu is not needed in embodiments of the steel composition, but may be present. In some embodiments, depending on the manufacturing process, the presence of Cu may be unavoidable. Thereafter, in an embodiment, the maximum Cu content may be 0.12% (or about 0.12%) or less.

In some embodiments, a steel composition can be provided comprising carbon (C), manganese (Mn), nickel (Ni), chromium (Cr), molybdenum (Mo), niobium (Nb), boron (B) and vanadium (V). The amount of each element is provided, in by weight of the total steel composition, such that the steel composition satisfies the formulas: C+Mn/10 between 0.1 and 0.4% (or about 0.1-0.4%) and Ni/10+Cr/12+Mo/8+Nb/2+20*B+V between 0.1 and 0.25% (or about 0.1-0.25%).

Further, a balanced content of aluminum, titanium, vanadium, niobium and nitrogen can be advantageous for optimal toughness. The amount of each element, based on stoichiometric relations, by weight of the total steel composition, can satisfy the formula: (Al/27+Ti/48+V/51+Nb/93−N/14)*100 between 0.08 and 0.15% (or about 0.08-0.15%).

In certain embodiments, steel compositions can comprise restricted ranges of C, Mn, Cr, Si, Mo, Nb, Ti, B, Al, V, Ni, S, P and N. These compositions are listed in Table 1 together with mentioned ranges, by weight of the total composition unless otherwise noted. In some embodiments, the steel compositions consist essentially of the restricted ranges of C, Mn, Cr, Si, Mo, Nb, Ti, B, Al, V, Ni, S, P and N. These compositions are listed below in Table 1, by weight of the total composition, unless otherwise noted.

TABLE 1

Embodiments of steel compositions.

| C | Mn | Cr | Si | Mo | Nb | Ti |
|---|---|---|---|---|---|---|
| 0.15-0.4 | 0.1-1.0 | 0.5-1.5 | 0.2-0.35 | 0.1-1.0 | 0.01-0.05 | 0.005-0.03 |
| 0.15-0.3 | 0.3-0.7 | 0.5-1.2 | 0.20-0.35 | 0.2-0.8 | 0.01-0.05 | 0.01-0.03 |
| 0.2-0.3 | 0.4-0.7 | 0.8-1.2 | 0.20-0.30 | 0.3-0.8 | 0.02-0.04 | 0.01-0.02 |

| B | Al | V | Ni | S | P | N |
|---|---|---|---|---|---|---|
| 0-50 ppm | 0.01-0.1 | 0-0.05 | 0-0.2 | 0-0.01 | 0-0.02 | 0-0.02 |
| 10-25 ppm | 0.01-0.05 | 0-0.05 | 0-0.2 | 0-0.008 | 0-0.018 | 0-0.015 |
| 10-20 ppm | 0.01-0.04 | 0-0.03 | 0-0.1 | 0-0.005 | 0-0.015 | 0-0.01 |

Carbon is an element which can improve the hardenability and increase the strength of the steel. If C content is below 0.15% (or about 0.15%), it may be difficult to achieve high levels of hardenability and strength. But C content exceeding 0.4% (or about 0.4%) may reduce the toughness of the steels. Accordingly, in some embodiments carbon content can be in the range of 0.15 to 0.4% (or about 0.15-0.4%). In some embodiments, carbon content can be in the range of 0.15 to 0.3% (or about 0.15-0.3%). In some embodiments, carbon content can be in the range of 0.2 to 0.3% (or about 0.2-0.3%).

Manganese is an element which also can improve hardenability and strength, but too high of Mn content can promote segregation of impurities that can reduce the toughness and corrosion-fatigue resistance of a steel. Accordingly, it can be advantageous to have a balance between C and Mn content. In some embodiments, manganese content can be in the range of, by weight 0.1 to 1.0% (or about 0.1-1.0%). In some embodiments, manganese content can be in the range of 0.3 to 0.7% (or about 0.3-0.7%). In some embodiments, manganese content can be in the range of 0.4 to 0.7% (or about 0.4-0.7%). %.

Chromium is an element which can improve hardenability, increase strength and also increase the tempering resistance of the steel. Further, Cr can increase corrosion resistance of a steel, being in solid solution. In some embodiments, chromium content can be in the range of 0.5 to 1.5% (or about 0.5-1.5%). In some embodiments, chromium content can be in the range of 0.5 to 1.2% (or about 0.5-1.2%). In some embodiments, chromium content can be in the range of 0.8 to 1.2% (or about 0.8-1.2%).

Silicon is an element that can have a deoxidizing effect during steel making process and can also raise the strength of a steel. If the Si content is too low, a high level of micro-inclusions due to oxidation can be present. Moreover, high Si content may decrease toughness and also can modify the adherence of oxides during rolling. In some embodiments, silicon content can be in the range of 0.2 to 0.35% (or about 0.2-0.35%). In some embodiments, silicon content can be in the range of 0.2 to 0.3% (or about 0.2-0.3%).

Molybdenum is an element which can have a strong effect on temperability. Mo also can improve hardenability and strength of a steel. However, Mo is an expensive element, and has a saturation level that can limit its desirable content. In some embodiments, molybdenum content can be in the range of, by weight 0.1 to 1.0% (or about 0.1-1.0%). In some embodiments, molybdenum content can be in the range of 0.2 to 0.8% (or about 0.2-0.8%). In some embodiments, molybdenum content can be in the range of 0.3 to 0.8% (or about 0.3-0.8%).

Vanadium is an element which can improve both hardenability and temperability of a steel, and its effect can be even stronger than that of Mo. Accordingly, V and/or Mo can be used to control dislocation density after tempering. However, vanadium can cause cracking in steel during manufacturing and, therefore, its content may be reduced. In some embodiments, vanadium content can be in the range of 0 to 0.05% (or about 0-0.05%). In some embodiments, vanadium content can be in the range of 0 to 0.03% (or about 0-0.03%).

Boron in small quantities can significantly increases hardenability of a steel. In some embodiments, boron content can be in the range of 0 to 50 ppm (or about 0-50 ppm). In some embodiments, boron content can be in the range of 10 to 25 ppm (or about 10-25 ppm). In some embodiments, boron content can be in the range of 10 to 20 ppm (or about 10-20 ppm).

Titanium can be added to increase the effectiveness of B in the steel. The role of titanium can be to protect boron from nitrogen by forming titanium nitride (TiN) particles. However, Ti can produce coarse TiN particles, which can lead to deterioration in toughness. In some embodiments, titanium content can be in the range of, by weight 0.005 to 0.03% (or about 0.005-0.03%). In some embodiments, titanium content can be in the range of 0.01 to 0.03% (or about 0.01-0.03%). In some embodiments, titanium content can be in the range of 0.01 to 0.02% (or about 0.01-0.02%).

Niobium is an element whose addition to the steel composition can refine the austenitic grain size during hot rolling, with the subsequent increase in both strength and toughness. Nb may also precipitate during tempering, increasing the steel strength by particle dispersion hardening. In some embodiments, niobium content can be in the range of, by weight 0.01 to 0.05% (or about 0.01-0.05%). In some embodiments, niobium content can be in the range of 0.02 to 0.04% (or about 0.02-0.04%).

Sulfur is an element that can cause the toughness of the steel to decrease. Accordingly, in some embodiments sulfur content is limited to a maximum of 0.01% (or about 0.01%). In some embodiments, sulfur content is limited to a maximum of 0.008% (or about 0.008%). In some embodiments, sulfur content is limited to a maximum of 0.005% (or about 0.005%).

Phosphorous is an element that can cause the toughness of the steel to decrease. Accordingly, in some embodiments phosphorous content is limited to a maximum of 0.02% (or about 0.02%). In some embodiments, phosphorous content is limited to a maximum of 0.018% (or about 0.018%). In some embodiments, phosphorous content is limited to a maximum of 0.015% (or about 0.015%).

Nitrogen is an element, if not fixed with Ti or Al, that can interact with B, thereby forming BN. This can reduce the overall amount of B in the alloy, which can reduce hardenability. Nickel can reduce the SSC resistance while increasing the toughness of the system. Aluminum can be used as a deoxidizing or killing agent.

In some embodiments, contents of unavoidable impurities including, but not limited to, Pb, Sn, As, Sb, Bi and the like, can be kept as low as possible. In some embodiments, each of the impurities is limited to 0.08 wt. % (or about 0.08 wt. %) or less. In some embodiments, each of the impurities is limited to 0.004 wt. % (or about 0.004 wt. %) or less. In some embodiments, Ca is limited to 0.004 wt. % (or about 0.004 wt. %) or less. In some embodiments, W is limited to 0.08 wt. % (or about 0.08 wt. %) or less. In some embodiments, the steel does not contain any Ni. In some embodiments, the steel does not contain any Ca, which can reduce the effectiveness of inclusion control. In some embodiments, the steel does not contain any W. In some embodiments, the steel does not contain any Ni.

Methods of Manufacturing

Also disclosed herein are embodiments of manufacturing methods that can be used to achieve advantageous properties in ultra-fine-grained steels.

In some embodiments, a steel composition, such as those described above, can be melted, for example, in an electric arc furnace (EAF), with an eccentric bottom tapping (EBT) system, or through any other melting system. In some embodiments, aluminum de-oxidation practice can be used to produce fine grain fully killed steel. Further, liquid steel refining can be performed by control of the slag and argon gas bubbling in the ladle furnace. Ca—Si wire injection treatment can be performed for residual non-metallic inclusion shape control. In some embodiments, none of the method is performed in a carburizing atmosphere.

After melting the steel, the melted steel can then be formed by hot rolling to a desired shapes, such as a steel rod or steel sucker rod. In some embodiments, the forging ratio, determined as the area ratio before and after hot rolling, can be at least 15:1 (or at least about 15:1). In some embodiments, a forging ratio of 34 (or about 34), 44.3 (or about 44.3), and 60.4 (or about 60.4) can be used. This high forging ratio can improve material homogeneity, thus improving the distribution of elements (e.g., reducing element segregation). Further, the high forging ratio can reduce corrosion due to micro galvanic effects.

Figure 7:
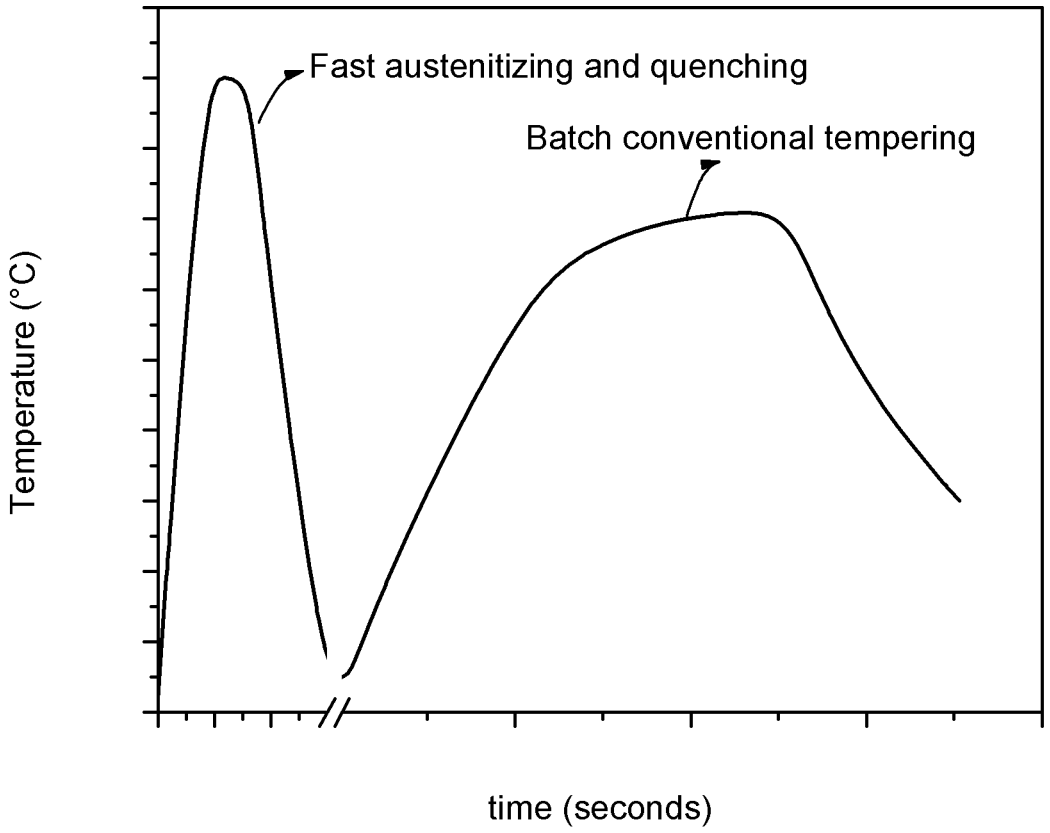
FIG. 7 illustrates an embodiment of a heat treatment of the disclosure.

In some embodiments, the formed steel can be heat treated, and an embodiment of the process is shown in FIG. 7. For example, the steel can be rapidly heated to an austenitizing temperature in a fast induction heating/hardening process, as shown as the first peak in FIG. 7. The steel can remain at this high austenitizing temperature and then quickly cooled below 100° C. (or about 100° C.). In some embodiments, the cooling rate can be greater than 50° C./s (or greater than about 50° C./s) In some embodiments, the steel can remain at the high temperature for just a few seconds. Further, the quenching can last only a few seconds as well. In some embodiments, the elapsed time between maximum temperature and fast cooling can be no less than 1 second and no more than 10 seconds (or about 1-10 seconds). Further, the austenitizing temperature in some embodiments can be no lower than the higher critical temperature (Ac3) and no higher than about a maximum that satisfies the formula $$T\,\max = 1025°\ \text{C.} - 210°\ \text{C.} * \text{sqrt}(\text{wt \% C}) + 50°\ \text{C.} * \text{wt \% } Mo.$$

Since the heating transformation to austenite can be a nucleation and growth process, the rapid heating (e.g., above 100° C./c or above about 100° C./s) up to the austenitizing temperature can lead to the nucleation of several small grains without having enough time for growth due to the fast cooling stage. For this to occur, it can be advantageous to have an adequate initial microstructure, homogeneous with an even carbon distribution, avoiding coarse precipitates. This initial microstructure of mainly bainite with a prior austentitic grain size no higher than 30 μm (or no higher than about 30 μm) can be achieved with the proper chemical composition and forging ratio, as described above.

In addition to providing for advantageous physical properties, the fast induction heating/hardening process can provide considerable energy savings over conventional furnace heating (up to 95% of energy savings), and can help to reduce $CO_2$ emissions.

After austenitizing and quenching, the steel can then be tempered, shown as the second increase in FIG. 7. In some embodiments, the steel can remain at the tempering temperature for between 40 minutes (or about 40 minutes) to 1 hour (or about 1 hour). In some embodiments, the steel can be tempered at a temperature higher than 565° C. (or about 565° C.), such as 720° C. (or about 720° C.) and lower than the lower critical temperature (Ac1).

The austenitizing and tempering treatments can be characterized by temperature equivalent parameters, using integral time-temperature equations:

$$P_{A/T}(T, t) = -B \Big/ \ln\left[\int_0^t \exp\left(-\frac{Q}{R \cdot T}\right) \cdot dt\right] \tag{1}$$

where T is the absolute temperature in ° K, t is the time in seconds, R is the gas constant (J/mol ° K), Q is an activation energy (425,000 J/mol) and B is a constant (14,000° C.). As austenitizing and tempering treatments are time and temperature dependent, the above formula can correlate both parameters into one parameter, which can be advantageous in providing the best combination of treatments.

In some embodiments, the $P_A$ parameter for austenitizing treatment is as low as possible. For example, in some embodiments $P_A$ can be below 800° C. (or below about 800° C.). In some embodiments, the $P_T$ parameter for tempering process can be as high as possible. For example, in some embodiments $P_T$ can be above 700° C. (or below about 700° C.). Further, in some embodiments the difference $P_A - P_T$ can be as low as possible. For example, in some embodiments the difference can be lower than 100° C. (or below about 100° C.). In some embodiments, the difference can be lower than 150° C. (or below about 150° C.). In some embodiments, the difference can be less than or equal to 200° C. (or below bout 200° C.). The combination of austenitizing and tempering conditions, in terms of time and temperature, can ensure the formation of a microstructure having fine grains with a fine well distributed carbide precipitates.

Embodiments of the disclosed ultra-fine grain steels using embodiments of the disclosed methods can have numerous advantageous physical characteristics. For example, in some embodiments the steels can have characteristics that can make them advantageous for use in sour service, or other corrosive environments. A discussion of ultra-fine grain steels can be found at Structural Ultrafine Grained Steels Obtained by Advanced Controlled Rolling, R. Gonzalez et al, Journal of Iron and Steel Research, International, 2013, 20 (1), 62-70, herein disclosed by reference in its entirety.

In some embodiments, the average grain size of the steel composition after heat treatment (e.g., after quenching or after tempering as tempering may not affect grain size) can be less than 5 μm (or less than about 5 μm). Moreover, the average grain size of the steel composition can be between 2 and 5 (or about 2 and about 5) micrometers after heat treatment. Such a reduction in grain size (from values between 10 and 20 micrometers for conventional treated steels) can increase the yield strength to tensile strength ratio while also enhancing the Charpy V-notch energy. In some embodiments, the structure can be full martensitic (90% minimum) which can improve the corrosion-fatigue resistance of the composition. In some embodiments, the final microstructure of the steel, such as those described above, can comprise tempered martensite with at least 90 (or at least about 90) volume % of martensite. As mentioned, the ultra-fine grained homogeneous structure notably improves the toughness of the steel.

In some embodiments, the steel can have a minimum yield strength of about 100 ksi and a target tensile strength between 115 and 140 (or about 115-140) ksi. Further, in some embodiments the steel can have a minimum absorbed energy in Charpy V-notch impact test of 100 (or about 100) Joules at room temperature.

EXAMPLES

The below examples illustrate the fatigue corrosion performance of a steel manufactured from embodiments of the above disclosure as compared to other chemical compositions or manufacturing routes.

Ultra-fine grain steels (UFGS), such as those described above, were manufactured at industrial scale complying with the following equations in order to investigate the effect of different elements and the performance of each steel chemical composition under different conditions (all UFGS steels and Set A):

$0.2\% < C + Mn/10 < 0.3\%$ $0.15\% < Ni/10 + Cr/12 + Mo/8 + Nb/2 + 20*B + V < 0.25\%$

Billets with an outside diameter of 148 mm were produced in a vertical continuous casting machine. Billets were heated up to 1270° C. and hot rolled to diameters ranging from 19 up to 32 mm.

Bars were then subjected to a fast induction heating reaching a target temperature of about 900° C. in about 4 seconds in the whole section, held at temperature for about 4 seconds and quenched in water down to below 100° C. in about 6 seconds. Different maximum temperatures were also used to analyze the effect of temperature on grain size for short time cycles. The lowest temperature can be advantageous for energy savings.

The as quenched bars were then subjected to a tempering process in a batch furnace, at about 710° C. during a total residence time of about 40 minutes. Ultimate tensile strengths between about 120 and 140 ksi were reached. Lower temperatures were also analyzed to reach different strengths.

Full size specimens were tensile tested as defined in ASTM A370 standard, hereby incorporated by reference in its entirety. Full size, 10×10, Charpy V-notch specimens were also obtained and tested according ASTM A370. Austenitic grain size was measured according ASTM E112, hereby incorporated by reference in its entirety, in the as quenched condition.

Corrosion fatigue tests were performed in specially dedicated machines. Other steels were also manufactured and tested for comparison:

- Set A: Steels with the same chemical composition as UFGS but with a different processing route: a lower forging ratio of 8.5 during rolling and a conventional batch quenching and tempering heat treatment (e.g., austenitization at an average of 1° C./s up to 900° C., held for 15 minutes, and quenched at 30° C./s. Tempering follows at 690° C. for about 1 hour). As a result, the austenitic grain size is about 10 microns.
- Set B: Quenched and tempered steels (treated in with heat treatment as above with regards to Set A) with composition, by weight 0.25% carbon, 1.20% manganese, 1.0% chromium, 0.25% silicon, 0.03% niobium, 0.01% titanium, 0.001% boron and 0.02% aluminum.
- Set C: Normalized and tempered steels with several chemical compositions and strengths like those typically found for steel sucker rod grades:
  - Steel 4142M with 0.42% carbon, 0.85% manganese, 1.0% chromium, 0.25% silicon, 0.2% molybdenum, and 0.02% aluminum.
  - Steel 4330M with 0.30% carbon, 0.80% manganese, 1.0% chromium, 0.25% silicon, 0.25% molybdenum, 1.7% Ni, 0.05% V and 0.02% aluminum.
  - Steel 4320M with 0.20% carbon, 0.90% manganese, 0.8% chromium, 0.25% silicon, 0.25% molybdenum, 1.2% Ni, 0.05% V and 0.02% aluminum.
  - Steel 4138M with 0.38% carbon, 1.20% manganese, 0.7% chromium, 0.25% silicon, 0.3% molybdenum, 0.05% V and 0.02% aluminum.

FIG. 1 illustrates the correlation between corrosion-fatigue resistance in harsh environments and impact toughness as determined experimentally, and clearly shows the beneficial effect of material toughness on corrosion-fatigue life. Furthermore, embodiments of steel from this disclosure presents improved performance, both in $CO_2$ and $H_2S$ harsh environments. Advantageously, disclosed herein are steels having a combination of an excellent toughness, and a good corrosion and sulfide stress cracking resistance. In fact, in some embodiments, steel rods of the present disclosure can have approximately twice the average life of conventional sucker rod materials in corrosion fatigue under $CO_2$ or $H_2S$ environments.

Specifically, the tests performed for FIG. 1 were carried out in simulated production environments, at 10 bar of partial pressure of $CO_2$. A simulated formation water composition used was 124 g/lt NaCl and 1.315 g/lt $NaHCO_3$, with predicted pH at test conditions of 5. The solution temperature was of 60° C. and the total pressure was 31 bar (reached using $N_2$ high purity) in all tests.

The tests in $H_2S$ were carried out in a buffering solution (adjusted by addition of HCl or NaOH) with a pH of 4.5, at 1 bar of pressure of (1 bar of total pressure) and at room temperature.

The maximum and minimum applied stresses were 47 Ksi and 12 Ksi respectively. The frequency of cycling was 20 cycles/min.

Figure 2:
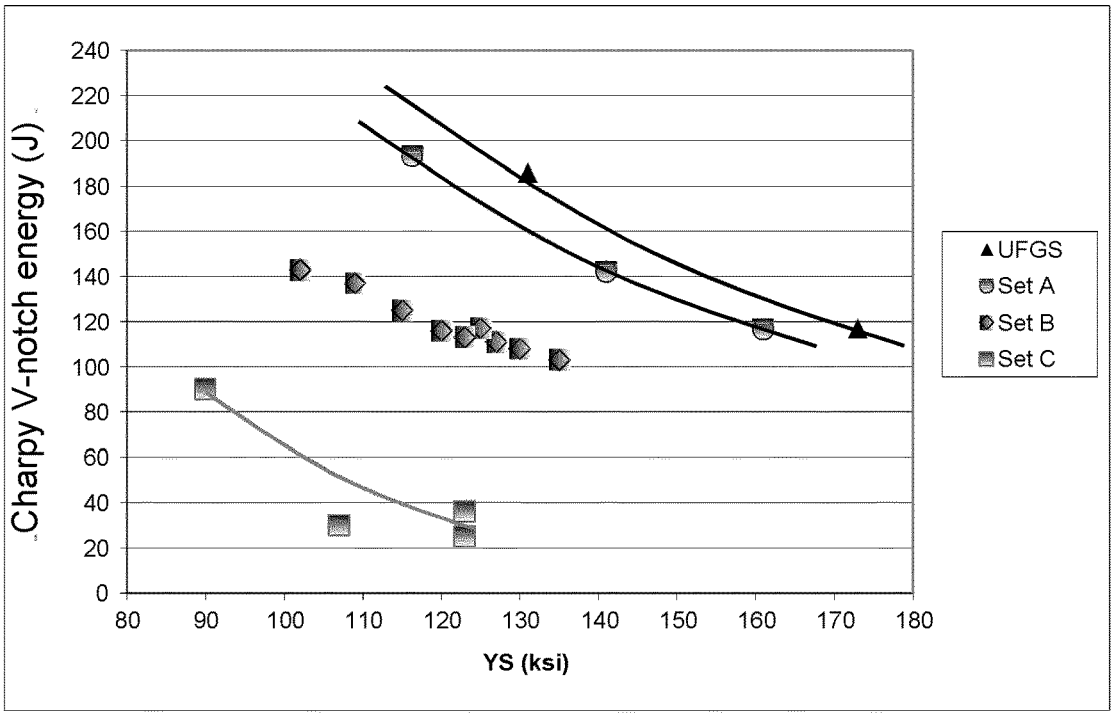
FIG. 2 illustrates testing results showing the effect of composition and heat treatment on toughness for embodiments of an ultra-fined-grained steel as compared to steels of the prior art.

Further, it can be advantageous to improve the toughness of the material, for example by means of a fine grained homogeneous microstructure. FIG. 2 shows the effect of composition and heat treatment on impact toughness measured as Charpy V-notch energy at room temperature. As shown in FIG. 2, embodiments of the ultra-fine grained steels of the present disclosure clearly show the better performance at all the yield strengths.

Results showed a good correlation between toughness as evaluated by Charpy V-notch energy at room temperature and corrosion fatigue life in two different environments: a buffered solution saturated with $CO_2$ at high pressure and 60° C., and another buffered solution saturated with $H_2S$ at 1 bar and room temperature (see FIG. 1). UFGS showed at least approximately twice the average life of conventional sucker rod materials (set C) in corrosion fatigue under $CO_2$ or $H_2S$ environments.

A remarkable improvement in toughness was achieved with the proper heat treatment, i.e., with the UFGS as compared with the other sets of steels. The chemical composition proves to have the desirable hardenability, necessary to attain a martensitic transformation. Furthermore, the alloy addition also was adequate to hit a high tempering temperature, reducing the dislocation density while keeping a high tensile strength. UFGS presented at least 10% more absorbed energy for the same strength (FIG. 2) than conventionally batch treated steels (set A), at least 20% more compared with other quenched and tempered steels (set B) and huge differences as compared with normalized and tempered steels (set C).

Figure 4:
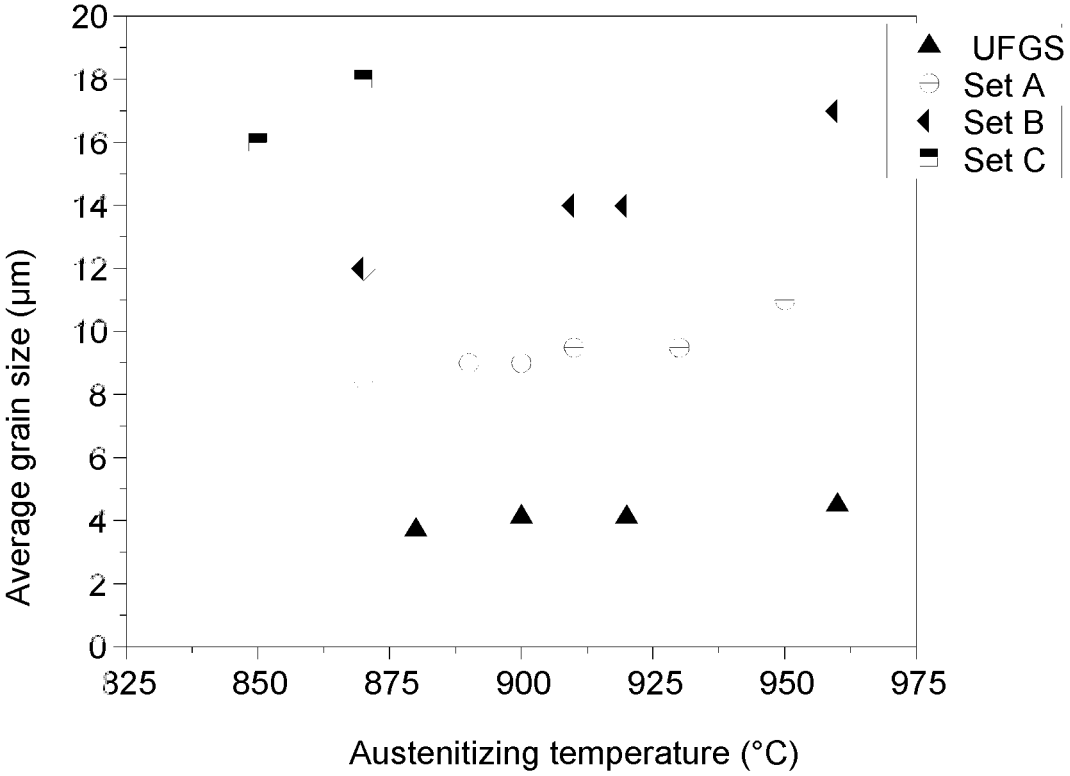
FIG. 4 illustrates testing results showing the effect of composition and heat treatment on grain size of embodiments of the disclosed steel.

FIG. 4 presents the effect of austenitizing temperature on grain size for different steel compositions and heat treatment methods. As shown, the UFGS is stable within a wide range of temperatures. This behavior is very advantageous from the point of view of manufacturing process, allowing a better control. Further, as can be observed in FIG. 4, there is not a big influence of temperature on grain size within the range 880-960° C.

Figure 5:
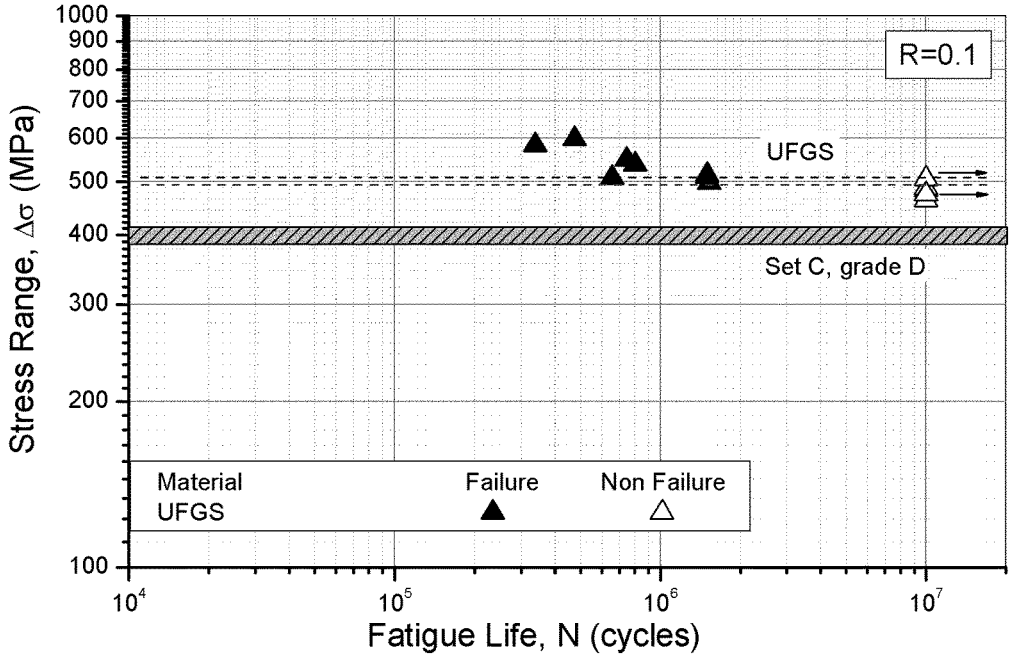
FIG. 5 illustrates testing results showing the effect of composition and heat treatment on fatigue life of embodiments of the disclosed steel.

FIG. 5 shows the effect of composition and heat treatment on fatigue life in air. The steels of the embodiments of the present disclosure have a better performance than conventional sucker rod steels. Accordingly, even in the absence of harsh environments, embodiments of the disclosed steel can have better, or at least the same, performance than a conventional sucker rod.

Figure 6:
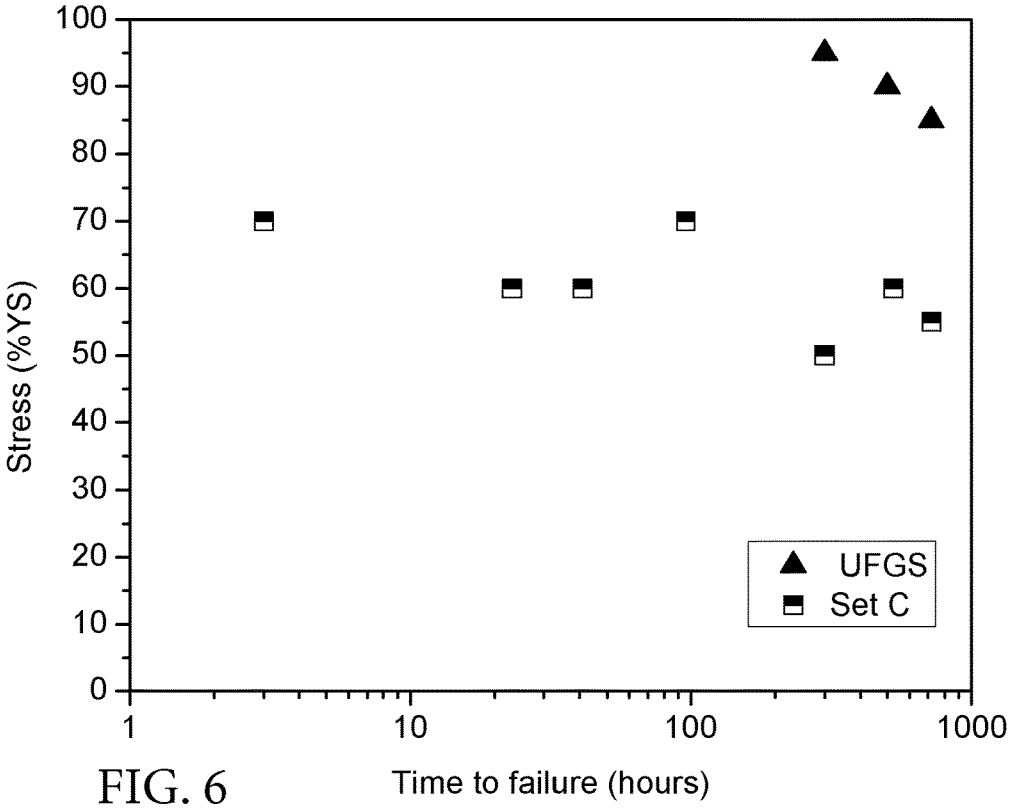
FIG. 6 illustrates testing results showing the effect of composition and heat treatment on SSC performance of embodiments of the disclosed steel.

FIG. 6 presents the effect of composition and heat treatment on sulfide stress cracking (SSC) performance. The steels of the embodiments of the present disclosure have an excellent behavior in static tests under wet hydrogen sulfide environments. This is again a consequence of the proper microstructure in terms of martensite content, grain size, carbide size, shape and distribution, and dislocation density.

From the foregoing description, it will be appreciated that an inventive corrosion resistant steels are disclosed. While several components, techniques and aspects have been described with a certain degree of particularity, it is manifest that many changes can be made in the specific designs, constructions and methodology herein above described without departing from the spirit and scope of this disclosure.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A method of manufacturing a steel sucker rod, the method including:

providing a steel having a composition comprising iron and:

0.15-0.4 wt. % carbon;
0.1-1.0 wt. % manganese;
0.5-1.5 wt. % chromium;
0.2-0.35 wt. % silicon;
0.1-1.0 wt. % molybdenum;
0.01-0.05 wt. % niobium;
0.005-0.03 wt. % titanium;
0.0001 to 0.0025 wt. % boron;
0.01 to 0.1 wt. % aluminum; and processing the steel, wherein the processing consists essentially of:

hot rolling the steel at a forging ratio greater than about 15 to form a steel sucker rod;

austenitizing the hot rolled steel sucker rod at a heating rate greater than about 100° C./sec to a temperature between a critical temperature (Ac3) and a maximum temperature that satisfies a formula Tmax=1025° C.-210° C.*sqrt(wt % C)+50° ° C.*wt % Mo to form an austenitized steel sucker rod;

quenching the austenitized steel sucker rod below about 100° C. at a rate to produce a martensitic microstructure to form a quenched steel sucker rod; and tempering the quenched steel sucker rod at a temperature between 565° C. and a lower critical temperature (Ac1) to form a tempered steel sucker rod comprising at least 90 volume % tempered martensite;

wherein a time between a maximum austenitizing and quenching is between 1 second and 10 seconds;

wherein an austenitic grain size prior to quenching is 5 microns or less, and wherein the processing does not comprise additional austenitizing or quenching steps.

2. The method of claim 1, wherein the austenitizing and tempering treatments are characterized by temperature equivalent parameters $$P_{A/T}(T,t) = -B \Big/ \ln\left[\int_0^t \exp\left(-\frac{Q}{R\cdot T}\right)\cdot dt\right]$$

where T is the absolute temperature in ° K, t is the time in seconds, R is the gas constant (J/mol ° K), Q is an activation energy (425,000 J/mol) and B is a constant (14,000° C.), $P_A$ is below 800° C., $P_T$ is above 700° C., and the difference between $P_A$ and $P_T$ is less than or equal to 200° ° C.

3. The method of claim 2, wherein the steel composition further comprises, by weight:

0 to 0.05 wt. % vanadium; and
0 to 0.2 wt. % nickel.

4. The method of claim 2, wherein the difference between $P_A$ and $P_T$ is less than 100° C.

5. The method of claim 1, wherein the austenitic grain size prior to quenching is between 2 and 5 microns.

6. The method of claim 1, wherein the austenitized steel sucker rod is quenched at a rate greater than about 50° C./sec.

7. The method of claim 6, wherein the steel composition comprises iron and, by weight:

0.15-0.3% carbon;
0.3-0.7% manganese;
0.2-0.35% silicon;
0.01-0.05% niobium;
less than 0.008% sulfur;
less than 0.018% phosphorus;
less than 0.015% nitrogen;
0.5-1.2% chromium;
0.2-0.8% molybdenum;
0.01-0.03% titanium;
0.0010 to 0.0025% boron; and
0.01 to 0.05% aluminum.

8. The method of claim 7, wherein the steel composition comprises iron and, by weight:

0.2-0.3% carbon;
0.4-0.7% manganese;
0.2-0.3% silicon;
0.02-0.04% niobium;
less than 0.005% sulfur;
less than 0.015% phosphorus;
less than 0.01 nitrogen;
0.8-1.2% chromium;
0.3-0.8% molybdenum;
0.01-0.02% titanium;
0.001 to 0.002% boron; and
0.01 to 0.04% aluminum.

9. The method of claim 1, wherein the tempered steel sucker rod comprises a yield strength greater than 100 ksi.

10. The method of claim 1, wherein the tempered steel sucker rod comprises an ultimate tensile strength between about 115 and about 140 ksi.

11. The method of claim 1, wherein the tempered steel sucker rod comprises a minimum absorbed energy in a Charpy V-notch impact test of 100 Joules at room temperature.

12. The method of claim 1, wherein the tempered steel sucker rod comprises:

a yield strength greater than about 100 ksi;

an ultimate tensile strength between about 115 and about 140 ksi; and a minimum absorbed energy in a Charpy V-notch impact test of 100 Joules at room temperature.

13. The method of claim 1, wherein an average grain size of the final microstructure of the tempered steel sucker rod is 5 microns or less.

14. The method of claim 1, wherein the heating rate is greater than the rate of quenching the austenitized steel sucker rod.

15. A method of manufacturing a steel sucker rod, the method including:

providing a steel having a composition comprising iron and:

0.15-0.4 wt. % carbon;
0.1-1.0 wt. % manganese;
0.5-1.5 wt. % chromium;
0.2-0.35 wt. % silicon;
0.1-1.0 wt. % molybdenum;
0.01-0.05 wt. % niobium;
0.005-0.03 wt. % titanium;
0.0001 to 0.0025 wt. % boron;
0.01 to 0.1 wt. % aluminum; and processing the steel, wherein the processing consists of:

hot rolling the steel at a forging ratio greater than about 15 to form a steel sucker rod;

austenitizing the hot rolled steel sucker rod at a heating rate greater than about 100° C./sec to a temperature between a critical temperature (Ac3) and a maximum temperature that satisfies a formula Tmax=1025° ° C.-210° ° C.*sqrt(wt % C)+50° C.*wt % Mo to form an austenitized steel sucker rod;

quenching the austenitized steel sucker rod below about 100° C. at a rate to produce a martensitic microstructure to form a quenched steel sucker rod; and tempering the quenched steel sucker rod at a temperature between 565° C. and a lower critical temperature (Ac1) to form a tempered steel sucker rod comprising at least 90 volume % tempered martensite;

wherein a time between a maximum austenitizing and quenching is between 1 second and 10 seconds; and wherein an austenitic grain size prior to quenching is 5 microns or less.

16. The method of claim 15, wherein the steel composition further comprises, by weight:

0 to 0.05 wt. % vanadium; and 0 to 0.2 wt. % nickel.

17. The method of claim 15, wherein the steel composition comprises iron and, by weight:

0.15-0.3% carbon;

0.3-0.7% manganese;

0.2-0.35% silicon;

0.01-0.05% niobium;

less than 0.008% sulfur;

less than 0.018% phosphorus;

less than 0.015% nitrogen;

0.5-1.2% chromium;

0.2-0.8% molybdenum;

0.01-0.03% titanium;

0.0010 to 0.0025% boron; and 0.01 to 0.05% aluminum.

18. The method of claim 15, wherein the steel composition comprises iron and, by weight:

0.2-0.3% carbon;

0.4-0.7% manganese;

0.2-0.3% silicon;

0.02-0.04% niobium;

less than 0.005% sulfur;

less than 0.015% phosphorus;

less than 0.01 nitrogen;

0.8-1.2% chromium;

0.3-0.8% molybdenum;

0.01-0.02% titanium;

0.001 to 0.002% boron; and 0.01 to 0.04% aluminum.

19. The method of claim 15, wherein the tempered steel sucker rod comprises a yield strength greater than 100 ksi.

20. The method of claim 15, wherein the tempered steel sucker rod comprises an ultimate tensile strength between about 115 and about 140 ksi.

21. The method of claim 15, wherein the tempered steel sucker rod comprises a minimum absorbed energy in a Charpy V-notch impact test of 100 Joules at room temperature.

22. The method of claim 15, wherein an average grain size of the final microstructure of the tempered steel sucker rod is 5 microns or less.

* * * * *